US006638702B2

(12) United States Patent
Sato et al.

(10) Patent No.: US 6,638,702 B2
(45) Date of Patent: Oct. 28, 2003

(54) SILVER HALIDE EMULSION

(75) Inventors: Tadanobu Sato, Kanagawa (JP); Tomonori Owaki, Kanagawa (JP); Takahiro Matsuno, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/987,399

(22) Filed: Nov. 14, 2001

(65) Prior Publication Data

US 2002/0098453 A1 Jul. 25, 2002

(30) Foreign Application Priority Data

Nov. 17, 2000 (JP) ..... P.2000-351151

(51) Int. Cl.[7] ..... G03C 1/005; G03C 1/09
(52) U.S. Cl. ..... 430/567; 430/569
(58) Field of Search ..... 430/567, 569

(56) References Cited

U.S. PATENT DOCUMENTS

| | | | | |
|---|---|---|---|---|
| 5,474,888 A | | 12/1995 | Bell | 430/567 |
| 5,783,373 A | * | 7/1998 | Mydlarz et al. | 430/363 |
| 5,783,378 A | * | 7/1998 | Mydlarz et al. | 430/567 |
| 5,962,210 A | | 10/1999 | Hahm et al. | 430/567 |

FOREIGN PATENT DOCUMENTS

| | | | |
|---|---|---|---|
| EP | 1 033 616 A1 | 9/2000 | G03C/1/08 |

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

The Silver halide grains in the silver halide emulsion is disclosed, comprising silver halide grains containing three or more kinds of transition metal complexes each having a different electron-releasing time respectively classified into any of Class A (100 seconds or more), Class B (more than 1/10 seconds and less than 100 seconds), Class C (more than 1/1000 seconds and 1/10 seconds or less) and Class D (1/1000 seconds or less).

12 Claims, No Drawings

SILVER HALIDE EMULSION

FIELD OF THE INVENTION

The present invention relates to a silver halide emulsion to be used in a silver halide photographic photosensitive material (i.e., a silver halide photographic light-sensitive material). In particular, the present invention relates to a silver halide emulsion having a high photosensitivity and a high gradation without reciprocity law failure owing to dopant techniques.

BACKGROUND OF THE INVENTION

As one of techniques of quality modification of silver halide grains for improving properties of the entire silver halide photographic photosensitive material as desired, there is known a technique (a doping technique) of incorporating other substance (a dopant) in addition to silver ions and halide ions.

Particularly, many studies have been done on doping techniques of transition metal ions. It is generally recognized that transition metal ions modify photographic properties effectively when they are incorporated into silver halide grains as a dopant even in an extremely small addition amount.

In order to improve photographic properties of a silver halide emulsion more effectively, not only techniques of doping transition metal ions but also techniques of doping transition metal complexes have been known. For obtaining an emulsion having a high photosensitivity, there are lots of disclosures of emulsions doped with a metal (in the group VIII of the periodic table) complex, particularly, taking six cyanide ions as ligands.

Hexacyano ferrate (II) complexes and hexacyano ferrate (III) complexes as a dopant including a cyanide ion are disclosed in (examined) Japanese Patent Publication No. 35373/1973. There are many other examples of obtaining a highly photosensitive emulsion by doping a hexacyano ferrous (II) complex, for example, disclosures in Japanese Patent Application Laid Open No. 66511/1993 (The term "Japanese Patent Application Laid Open" means an unexamined published Japanese Patent application") and U.S. Pat. No. 5,132,203. Highly photosensitive emulsions obtained by doping other cyano complexes than an iron complex are known. Namely, it is disclosed in Japanese Patent Application Laid Open No. 20853/1990 that a highly photosensitive emulsion is obtained by doping a complex of rhenium, ruthenium, osmium or iridium into silver iodochloride. In order to improve reciprocity law failure, in particular, high intensity reciprocity law failure, an iridium complex is used. Examples of doping an iridium complex into silver halide grains are disclosed in Japanese Patent Application Laid Open Nos. 285941/1989, 118583/1991, 213449/1992, 278940/1992, 66511/1993, 313277/1993, 82947/1994, 235995/1994, 72569/1995, 72576/1995, 202440/1999 and 295841/1999, wherein $H_2O$, cyano, nitrosyl or thionitrosyl is used as a ligand for an iridium complex.

Gradient is one of important photographic properties of the sliver halide emulsion. A doping technique is also used for obtaining a sliver halide emulsion having a high gradient.

As disclosed in European Patents 033642, 0606895 and 0610670, techniques using nitrosyl or thionitrosyl as a ligand of a transition metal complex are known for obtaining a high gradient emulsion, namely, an emulsion having a high contrast. In this case, ruthenium or osmium is mainly used as a central metal.

Besides using nitrosyl or thionitrosyl, effectiveness of using hexachloro ruthenium, hexachloro rhodium or hexachloro rhenium for obtaining a contrast-increasing emulsion is described in Japanese Patent Application Laid Open Nos. 184740/1988, 285941/1989, 20852/1990 and 20855/1990.

Further, in recent years, techniques of doping a complex having an organic compound as its ligand into silver halide grains to modify properties of the emulsion have been disclosed. Many examples of using a complex having an organic compound as its ligand are shown in U.S. Pat. Nos. 5,360,712, 5,457,021 and 5,462,849, European Patent 0709724, and Japanese Patent Application Laid Open Nos. 71569/1995 and 179452/1996. Particularly, it is described in the above references that remarkable effects of increasing photosensitivity are obtained when $[(NC)_5Fe(\mu\text{-}4,4'\text{-bipyridine})Fe(CN)_5]^{6-}$ is doped, and further that high intensity reciprocity law failure is effectively improved when $[IrCl_5(thia)]^{2-}$ is doped. Emulsions having a high photosensitive with improved reciprocity law failure are obtained in Japanese Patent Application Laid Open No. 24194/1999 by doping $[Fe(CO)_4(P(Ph)_3)]^0$ or $[Fe(CO)_3(P(Ph)_2)]^0$. Also, highly photosensitive emulsions are obtained in Japanese Patent Application Laid Open No. 102042/1999 when L is 2-mercaptobenzimidazole, 5-methyl-s-triazolo(1.5-A) pyrimidine-7-ol or 2-mercapto-1,3,4-oxadoazole in the complexes of $[M(CN)_5L]^{3-}$ ($M=Fe^{2+}$, $Ru^{2+}$ or $Ir^{3+}$), $[Fe(CO)_4L]]^0$, $[M'(CN)_3L]^-$ ($M'=Pd^{2+}$ or $Pt^{2+}$), or $[IrCl_5L]^-$ type. Further, it is indicated in Japanese Patent Application Laid Open No. 293377/1998 that are markable contrast-increasing emulsion is obtained when $[RuCl_5L']^{2-}$ (L'= imidazole, benzimidazole or derivative thereof) is doped, and that the photosensitivity of the emulsion becomes drastically higher than that of an emulsion using a conventional dopant for obtaining high contrast with desensitization.

These dopants improve photographic properties effectively even when a single dopant is solely used. However, when a plurality of dopants are simultaneously used, an emulsion having each quality of dopants in combination can be obtained.

For obtaining an emulsion having both of a high photosensitivity and a high contrast, techniques of using a combination of a ruthenium complex or an osmium complex with nitrosyl as a ligand of complex and an iron complex or a ruthenium complex with a cyanide ion as a ligand are disclosed in U.S. Pat. No. 5,480,771 and European Patents 0606893, 0606894, 0606895 and 0610670. An emulsion having a high photosensitivity and no reciprocity law failure is realized by using a hexacyano complex and an iridium complex in combination as disclosed in Japanese Patent Application Laid Open Nos. 125425/1990, 132647/1991 and 188437/1991. An emulsion having a high contrast and an excellent property in low intensity and/or high intensity reciprocity law failure can be obtained by using a combination of a ruthenium complex or an osmium complex with nitrosyl as a ligand of complex and an iridium complex as described in U.S. Pat. Nos. 5,474,888 and 5,500,335 and Japanese Patent Application Laid Open No. 51233/1992.

Further, by using three kinds of dopants in combination, an emulsion having a high photosensitivity, a high contrast and less reciprocity law failure can be obtained. Such emulsions having a high photosensitivity, a high contrast and less reciprocity law failure by using hexacyano ruthenium (II) as a dopant for high photosensitivity, pentachloronitrosyl osmium (II) as a dopant for high contrast and hexachloro iridium (III or IV) as a dopant for improving reciprocity law failure are disclosed in Japanese Patent Application Laid Open Nos. 314043/1996, 328182/1996, 211529/1996 and 211530/1996 and U.S. Pat. No. 5,480,771. In addition to the above, disclosure examples of using three kinds of dopants include descriptions in Japanese Patent Application Laid Open No. 282114/1999. In this example, by using pentachloronitrosyl osmium, hexachloro iridium and pentachloro(thiazole)iridium in combination, an emulsion having a high contrast and no reciprocity law failure in a broad range of exposure light intensity is obtained.

However, there is no disclosure example of a silver halide emulsion using four kinds of dopants in combination and of an emulsion using a dopant with a cyanide ion as a ligand, which is a dopant for high photosensitivity, and three or more kinds of dopants in combination. Any example that an emulsion having a high photosensitivity, no reciprocity law failure in a broad range of exposure light intensity and a high contrast was obtained has not been known yet.

SUMMARY OF THE INVENTION

The object of the present invention is to provide a silver halide photographic photosensitive material having a higher photosensitivity, no reciprocity law failure in a broad range of exposure light intensity and a higher contrast (1) An silver halide emulsion for a silver halide photographic photosensitive material comprising a support having thereon at least one silver halide emulsion layer containing the silver halide emulsion, wherein the silver halide emulsion comprises silver halide grains containing three or more kinds of transition metal complexes each having a different electron-releasing time.

(2) The silver halide emulsion as described in (1), wherein an electron-releasing time owned by each of three or more kinds of transition metal complexes contained in the silver halide grains is classified into any of Class A (100 seconds or more) Class B (more than 1/10 seconds and less than 100 seconds), Class C (more than 1/1000 seconds an 1/10 seconds or less) or Class D (1/1000 seconds or less), respectively.

(3) The silver halide emulsion as described in (2), wherein four or more kinds of transition metal complexes, electron-releasing times of which are classified into any of Class A to Class D, are contained in the silver halide grains.

(4) The silver halide emulsion as described in (2), wherein three kinds of transition metal complexes, electron-releasing times of which are classified into Class B, Class C and Class D respectively, or into Class A, Class C and Class D, are contained in the silver halide grains.

(5) The silver halide emulsion as described in any of (1) to (4), wherein each of the three or more kinds of transition metal complexes contained in the silver halide grains respectively comprises at least one central metal selected from the group consisting of ruthenium, osmium, rhodium, iridium, iron, cobalt, nickel, zinc, lead and cadmium.

(6) The silver halide emulsion as described in (4), wherein at least one of three kinds of transition metal complexes contained in the silver halide grains is classified into Class C.

(7) The silver halide emulsion as described in (3), wherein at least one of four or more kinds of transition metal complexes contained in the silver halide grains is classified into Class C.

(8) The silver halide emulsion as described in any of (1) to (7), wherein at least one of the three or more kinds of transition metal complexes contained in the silver halide grains is an iridium complex or a ruthenium complex having at least one halogen ion as a ligand.

(9) The silver halide emulsion as described in (6) or (7), wherein a complex in Class C contained in the silver halide grains is an iridium complex or a ruthenium complex.

(10) The silver halide emulsion as described in (6) or (7), wherein a complex in Class C contained in the silver halide grains included in the emulsion is an iridium complex represented by General Formula (I):

$$[IrX_nL_{6-n}]^m \quad (I)$$

wherein X represents a halogen ion, L represents an inorganic compound or an organic compound except halogen, n represents 4 or 5 and m represents an integer of from −4 to +2 (i.e., 4−, 3−, 2−, 1−, 0, 1+, 2+).

(11) The silver halide emulsion as described in (2) to (10), wherein a complex in Class B contained in the silver halide grains is an iridium complex or a ruthenium complex having at least one halogen ion as its ligand.

(12) The silver halide emulsion as described in (2) to (11), wherein a transition metal complex in Class D contained in the silver halide grains has at least one cyanide ion as its ligand.

DETAILED DESCRIPTION OF THE INVENTION

The present invention will be described in detail hereinafter.

High intensity reciprocity law failure occurs when many photoelectrons are generated in a silver halide grain at exposure to high intensity light to result in dispersion of latent images. Therefore, high intensity reciprocity law failure can be improved by building such a function in the silver halide grain that many photoelectrons generated by exposure to high intensity light are temporarily removed from the conduction band to take shelter and to be released again into the conduction band after staying for a certain time. This means that the condition in the silver halide grain at exposure to high intensity light is converted to the same condition as that at exposure to low intensity light. The function of taking temporary shelter, namely, a function of trapping photoelectrons temporarily can be realized by doping a transition metal complex (such a dopant is called as an electron-(gradually) releasing dopant or an intensity conversion dopant). As a transition metal complex for improving high intensity reciprocity law failure, hexachloro iridium has been used heretofore. In case of using hexachloro iridium, photoelectrons generated by exposure to high intensity light are trappeded by the lowest unoccupied molecular orbital of iridium, which is the central metal, and released again into the conduction band after staying at the orbital in a certain time. This time since the exposure to light until when the trapped electrons are redischarged is defined as an electron-releasing time.

The electron-releasing time can be determined by either of a reciprocity law failure curve or a double flash photoconduction method. In the present invention, it was determined by the reciprocity law failure curve. The reciprocity law failure curve can be drawn as described in Fundamentals of *Photographic Engineering—Silver Halide Photography—, revised edition*, compiled by The Society of Photographic Science and Technology of Japan, pp. 297. A conventional silver halide emulsion, particularly, a silver chloride emulsion gives a curve having a convex downwards because it has the highest photosensitivity around medium intensity and shows desensitization at both of the low intensity side and the high intensity side. On the contrary, an emulsion improved for high intensity reciprocity law failure by doping an electron-(gradually) releasing dopant gives a reciprocity law failure curve having a flat region in the high intensity side over a certain exposure intensity without desensitization. The shape of the doped curve is different from that of the undoped reciprocity law failure curve. The exposure time at this exposure intensity to tend to be flat, namely, the exposure time at the exposure intensity to initiate the difference from the undoped reciprocity law failure curve is assumed as an electron-(gradually) releasing time. Since the effect of electron-(gradually) releasing (redischarge of photoelectrons) does not appear until exposure has been completed, the time when the effect of electron-(gradually) releasing appears photographically can be defined as a time when redischarge of photoelectrons starts, that is, the electron-releasing time.

In case that an exposure light source is constant, an electron-releasing time maybe set solely for a certain exposure intensity. However, for obtaining an emulsion which always gives the same photographic properties in response to a variety of light sources, it becomes necessary that each dopant having a proper electron-releasing time corresponding to intensity of each exposure light source is incorporated into the silver halide grains.

Not only the intensity conversion dopant, but also a contrast increasing dopant or a high photosensitivity dopant can be discussed in relation to the electron-releasing time.

The high contrast dopant reveals its contrast increasing action by trapping photoelectrons generated by exposure to light at the dopant sites and without redischarging or by releasing photoelectrons after a long time (several hours to several years) has elapsed. On the other hand, the high photosensitivity dopant such as hexacyano iron introduces shallow electron traps caused by a Coulomb field in the silver halide grain as indicated in *Bulgarian Chem. Commun.*, 20 (1993) 350–368, *Radiat. Eff. Defects Solids*, 135 (1995) 101–104 and J. Phys., *Condens Matter*, 9 (1997) 3227–3240. These dopant sites repeat trapping-and-releasing of photoelectrons through having an extremely short electron-releasing time.

Photoelectrons can, therefore, stay in the conduction band apparently without being deactivated until an interstitial silver i on is supplied or until a photoelectron transfers up to an interstitial silver ion. Through such a way, a high photo sensitivity can be achieved.

As stated in the above, the concept of the electron-releasing time is an important concept on photographic properties. By using dopants each having a proper electron-releasing time in proper combination, a silver halide emulsion f or which photosensitivity, gradation and reciprocity law failure properties are intentionally controlled can be designed. However, any disclosure example having description concerning the electron-releasing time has not been found heretofore.

The electron-releasing times owned by transition metal complexes can be classified into the following four classes based on the photographic properties when they are doped. Class A includes dopants having an electron-releasing time of 100 seconds or more and showing a contrast increasing action. Class B includes dopants having an electron-releasing time of more than 1/10 seconds and less than 100 seconds and improving high intensity reciprocity law failure in a relatively low intensity region of from about 1/10 seconds to about 1/1000 seconds in terms of an exposure time. Class C includes dopants having an electron-releasing time of more than 1/1000 seconds and 1/10 seconds or less and improving high intensity reciprocity law failure in a relatively high intensity region of from about 1/1000 seconds to about $10^{-6}$ seconds. Class D includes dopants having an electron-releasing time of 1/1000 second or less and $10^{-6}$ seconds or more which repeat trapping-and-releasing in an extremely short time as described above to be high photosensitivity dopants.

In the present invention, examples of the transition metal complex which can preferably be incorporated into the inside or on the surface of silver halide grain in the process of forming and/or growing silver halide grains are described below. For a metal ion used as the central metal of a complex, an iron ion, a ruthenium ion, an iridium ion, an osmium ion, a lead ion, a cadmium ion or a zinc ion is preferable. It is preferred to use these metal ions accompanied with ligands as an octahedron-shaped complex with six coordinations. In case of using an inorganic compound as a ligand, it is preferred to use a cyanide ion, a halide ion, a thiocyanate ion, a hydroxide ion, aperoxideion, anazideion, anitriteion, water, ammonia, a nitrosyl ion or a thionitrosyl ion. These ligands can preferably be coordinated to any of metal ions described in the above. To coordination positions of a metal ion, the same ligands are preferably coordinated and plural kinds of ligands are also preferably coordinated simultaneously. Further, an organic compound can also be used as a ligand. As a preferable organic compound, a chain-like compound having five carbon atoms or less in the main chain and/or a heterocyclic compound having a five-membered ring or a six-membered ring can be exemplified.

More preferable organic compounds are compounds having in the molecule a nitrogen atom, a phosphor atom, an oxygen atom or a sulfur atom as a coordination atom to a metal. Preferable examples of the compounds are furan, thiophene, oxazole, iso-oxazole, thiazole, isothiazole, imidazole, pyrazole, triazole, furazan, pyran, pyridine, pyridazine, pyrimidine and pyrazine. Furthermore, compounds in which a substituent is introduced to a basic structure of the foregoing compounds are also preferable.

When these complexes include incorporated into silver halide grains, it is preferable that the complex is uniformly distributed in the internal part of the grain, also that the complex is localized solely in the surface layer of the grain as disclosed in Japanese Patent Application Laid Open Nos. 208936/1992, 125245/1990 and 188437/1991, and further that the complex is localized solely in the internal part of the grain and a layer containing no complex is provided on the grain surface. Also, it is preferable that the complex is physically ripened with fine grains incorporated into the internal part of the grain to modify the grain surface layer as disclosed in U.S. Pat. Nos. 5,252,451 and 5,256,530. Further, these method can be used in combination and plural kinds of complexes may be incorporated in one silver halide grain. The halogen composition at the position where the complex is incorporated is not particularly limited. It is also preferable that the complex is contained in any of a silver chloride layer, a silver chlorobromide layer, a silver bromide layer, a silver iodochloride layer and a silver iodobromide layer.

For dopants in Class A, transition metal complexes containing a metal selected from a group including ruthenium, osmium, rhodium and iridium as the central metal are preferred. Specific examples of the dopant in Class A include hexachloro ruthenium, pentachloroaqua ruthenium, pentachloronitrosyl ruthenium, pentachlorothionitrosyl ruthenium, hexachloro osmium, pentachloronitrosyl osmium, pentachlorothionitrosyl osmium, hexachloro rhodium and pentachloroaqua rhodium. Among these, pentachloronitrosyl ruthenium, pentachloronitrosyl osmium, hexachloro rhodium and pentachloroaqua rhodium are particularly preferred. These dopants in Class A are preferably added during grain formation in an amount in the range of from $1\times10^{-10}$ mol to $1\times10^{-6}$ mol per 1 mol of silver, and more preferably in the range of from $1\times10^{-9}$ mol to $1\times10^{-6}$ mol. Further, these dopants maybe uniformly doped in the internal part of the grain, and it is preferred that the dopants are doped not to be exposed on the grain surface and that the dopants are doped in the part ranged from the grain center to 80% of the grain volume. It is also preferred that the dopants are doped in the layer including 80% of the grain volume except the part to be a nucleus in grain formation.

For dopants in Class B, transition metal complexes containing a metal selected from a group including iridium and ruthenium as the central metal are preferred. Hexachloro iridium and hexabromo iridium are more preferable and hexachloro iridium is particularly preferable.

These complexes are preferably added during grain formation in an amount in the range of from $1\times10^{-9}$ mol to $1\times10^{-6}$ mol per 1 mol of silver. Dopants in Class B may be uniformly doped in the internal part of the grain. However, it is preferable that the dopants are doped in the outer layer of more than 70% of the grain volume counted from the center part of the grain.

It is more preferable that the dopants are doped in the layer ranged from 85% to 98% of the grain volume counted from the center part. In case of a silver chloride emulsion, when a silver bromide layer is formed as the grain surface layer, the dopants may be localized in the silver bromide layer. An electron-releasing time of a silver chloride cube (grain size: 0.38 $\mu$m) emulsion doped with the hexachloro iridium complex by a method of the present invention can be estimated as taking a value between 10 seconds and 100 seconds.

For dopants in Class C, transition metal complexes containing a metal selected from a group including iridium and ruthenium as the central metal are preferred. In Particular, iridium complexes are preferable. As iridium complexes, those represented by General Formula (I) are preferable.

In General Formula (I), a preferable halogen ion represented by X is a chlorine ion or a bromine ion.

Examples of the inorganic compound represented by L include those described as examples in case of using an inorganic compound described above as a ligand, and preferably a thiocyanate ion, water, ammonia and a nitrite ion.

Examples of the organic compound represented by L include those described as organic compounds described below. Further, when n=4, the organic compound may be a bidentate ligand.

Specific examples of the dopant in Class C include pentachloroaqua iridium, tetrachloroaqua iridium, pentabromoaqua iridium, tetrabromoaqua iridium and tribromotriaqua iridium.

A complex belonging to Class C preferably has an organic compound as a ligand. As a preferable organic compound, a chain-like compound having five carbon atoms or less in the main chain and/or a heterocyclic compound having a five-membered ring or a six-membered ring can be exemplified. More preferable organic compounds are compounds having in the molecule a nitrogen atom, a phosphor atom, an oxygen atom or a sulfur atom as a coordination atom to a metal. Preferable examples of the compounds are furan, thiophene, oxazole, iso-oxazole, thiazole, isothiazole, imidazole, pyrazole, triazole, furazan, pyran, pyridine, pyridazine, pyrimidine and pyrazine. Furthermore, compounds in which a substituent is introduced to a basic structure of the foregoing compounds are also preferable. Particularly preferable complexes having an organic compound as a ligand are pentachloro(thiazole)iridium, pentachloro(pyridine)iridium and pentachloro(pyrazine)iridium.

These dopants in Class C are preferably added during grain formation in an amount of from $1\times10^{-6}$ mol to $5\times10^{-4}$ mol per 1 mol of silver, and more preferably from $1\times10^{-7}$ mol to $1\times10^{-5}$ mol. These dopants may be uniformly doped in the internal part of the grain. However, it is preferable that the dopants are doped in the outer layer of more than 70% of the grain volume counted from the center part of the grain.

It is more preferable that the dopants are doped in the layer ranged from 85% to 98% of the grain volume counted from the center part. An electron-releasing time of a silver chloride cube (grain size: 0.38 $\mu$m) emulsion doped with the pentachloro(thiazole)iridium complex by a method of the present invention and of the same emulsion doped with the pentachloroaqua iridium complex can respectively be estimated as taking a value between 1/10 seconds and 1/100 seconds.

For dopants in Class D, transition metal complexes containing a metal selected from a group including iron, ruthenium, cobalt, iridium, nickel, zinc and lead as the central metal are preferred. A preferable combination of a metal ion and a ligand is a combination of an iron ion or a ruthenium ion with a cyanide ion. In these compounds, it is preferable that cyanide ions occupy at least a half of coordination numbers to iron or ruthenium as the central metal and the rest of coordination positions are preferably occupied by thiocyan, ammonia, water, a nitrosyl ion, dimethyl sulfoxide, pyridine, pyrazine or 4,4'-bipyridine. It is particularly preferred that all of the six coordination positions of the central metal are occupied by cyanide ions to form a hexacyano iron complex or a hexacyano ruthenium complex. The use of a hexacyano ruthenium complex is particularly preferable.

These complexes are preferably added during grain formation in an amount of from $1\times10^{-7}$ mol to $1\times10^{-3}$ mol per 1 mol of silver, and more preferably from $1\times10^{-6}$ mol to $5\times10^{-4}$ mol per 1 mol of silver. These dopants may be uniformly doped in the internal part of the grain. However, it is preferable that the dopants are doped in the outer layer of more than 60% of the grain volume counted from the center part of the grain. It is more preferable that the dopants are doped in the layer ranged from 70% to 90% of the grain volume counted from the center part.

When the dopants in Class A to D are incorporated into silver halide grains, doped layers may be ovelapped one another.

However, it is preferable that layers containing dopants for each layer do not overlap one another.

In the present invention, the complexes are preferably incorporated into silver halide grains by adding them in a reaction solution directly during silver halide grain formation, in a halide solution for forming silver halide grains, or in other solutions to be added to the reaction solution for grain formation. Further, the complexes are preferably incorporated into silver halide grains by using these methods in combination.

The silver halide grains in the silver halide emulsion to be used in the present invention are preferably crystalline grains of cubes having {100} faces substantially or tetradecahedrons (these may have rounded grain corners and a hkl plane) or crystalline grains of octahedrons, or tabular grains, 50% or more of the whole projection area of which is made of {100} faces or {111} faces, having a two or more aspect ratio. The aspect ratio is a value of a diameter of a circle corresponding to the projection area divided by a grain thickness. In the present invention, cubes or tabular grains having {100} faces as the main planes or tabular grains having {111} faces as the main planes are preferably applied.

As the silver halide emulsion to be used in the present invention, a silver chloride, silver bromide, silver iodobromide or silver chloro(iodo)bromide emulsion can be used. In viewpoint of rapid processing properties, a silver chloride, silver chlorobromide, silver iodochloride or silver chloroiodobromide emulsion having a silver chloride content ratio of 95 mol % or more is preferable, and a silver chloride, silver chlorobromide, silver iodochloride or silver chloroiodobromide emulsion having a silver chloride content ratio of 98 mol % or more is more preferable. Among these silver halide emulsions, those having a silver iodochloride phase in the shell part of the silver halide grain in an amount ranged from 0.01 mol % to 0.50 mol % per 1 mol of the entire silver are preferable. Emulsions having a silver iodochloride phase in an amount of from 0.05 mol % to 0.40 mol % are more preferable, because a high photosensitivity and an excellent high intensity exposure property can be obtained.

Further, silver halide emulsions having a localized silver bromide phase on the surface of the silver halide grain in an amount ranged from 0.2 mol % to 5 mol % per 1 mol of the entire silver are preferable. Emulsions having a silver bromide phase in an amount of from 0.5 mol % to 3 mol % are particularly preferable, because a high photosensitivity can be obtained, and moreover, stabilized photographic properties can be achieved.

In case that the emulsion of the present invention contains silver iodide, the incorporation of sliver iodide may be done by adding an iodide salt solution independently, or by adding the iodide salt solution in combination with addition of a silver salt solution and a high chloride (content) salt solution. In the latter case, the iodide salt solution and the high chloride salt solution may be added separately, or a mixed solution of the iodide salt and the high chloride salt may be added. The iodide salt is added in a form of a soluble salt such as an alkali or alkali-earth iodide salt. An iodide can also be incorporated by cleaving an iodide ion from an organic molecule as described in U.S. Pat. No. 5,389,508. Further, fine silver iodide grains can also be used as another source of iodide ions.

Addition of the iodide salt solution may be conducted intensively at a time of grain formation or over a certain period. The position of incorporating iodide ions into a high chloride emulsion is limited for obtaining an emulsion having a high photosensitivity as well as a low fog. When the incorporation of iodide ions is performed into the more inner part of an emulsion grain, the smaller increase of photosensitivity is obtained. Therefore, addition of the iodide salt solution is preferably done in the more outer part than 50% of the grain volume, more preferably in the more outer part than 70%, and in particular, preferably in the more outer part than 80%. Addition of the iodide salt solution is preferably completed in the more inner part than 98% of the grain volume, and in particular, preferably in the more inner part than 96%.

By completing addition of the iodide salt solution at a slightly inner part from the grain surface, an emulsion having a higher photosensitivity as well as a low fog can be obtained.

A distribution of iodide ion concentration in the direction to the depth in a grain can be measured by a method of Etching/TOF-SIMS (Time of Flight-Secondary Ion Mass Spectrometry), for example, by using a TOF-SIMS apparatus (manufactured by Phi Evans Co.). Regarding the TOF-SIMS method, specific descriptions are found in *Surface Analysis Techniques Series—Secondary Ion Mass Spectrometry Method*, compiled by The Society of Surface Science of Japan, Maruzen, 1999. When the emulsion grain is analyzed by the Etching/TOF-SIMS method, it can be analyzed that iodide ions are penetrating out toward the grain surface, even if addition of the iodide salt solution has been completed in the inside of grain. In case that the emulsion of the present invention contains silver iodide, it is preferred that iodide ions have their maximum concentration at the grain surface and the concentration of iodide ions is decreasing toward the inner part as a result of analysis by the Etching/TOF-SIMS method.

In case that the emulsion of the present invention contains a localized silver bromide phase, it is preferred that the localized silver bromide phase having a silver bromide content ratio of 10 mol % or more is formed by epitaxial growth on the grain surface. The silver bromide content ratio of the localized silver bromide phase is preferably in the range of from 10 mol % to 60 mol %, and in particular, preferably in the range of from 20 mol % to 50 mol %. The localized silver bromide phase preferably comprises a silver amount ranged from 0.1 mol % to 5 mol % of the entire silver amount consituting the silver halide grain in the present invention, and more preferably comprises a silver amount ranged from 0.3 mol % to 4 mol %. It is preferred that the localized silver bromide phase contains a metal complex ion belonging to the group VIII in the periodic table such as iridium (III) chloride, iridium (III) bromide, iridium (IV) chloride, sodium hexachloro iridate (III), potassium hexachloro iridate (IV), a hexa-amine iridium (IV) salt, a tri-oxalate iridium (III) salt and a tri-oxalate iridium (IV) salt. An addition amount of these compounds may vary in a broad range according to the purpose and is preferably in the range of from $10^{-9}$ mol to $10^{-2}$ per 1 mol of silver.

An average grain size (a grain size is approximated as a diameter of a circle equivalent to the projection area of the grain and the average grain size is a number average of such grain sizes) of the silver halide grains included in the silver halide emulsion to be used in the present invention is preferably in the range of from 0.1 $\mu$m to 2 $\mu$m.

Further, a grain size distribution of the grains is preferably the so-called monodispersed one with a variation coefficient of 20% or less, preferably 15% or less, and more preferably 10% or less. It is also preferably performed that monodispersed emulsions described in the above are used as a blend in the same layer or used in multi-layer coating for the purpose of obtaining a broader latitude.

To the silver halide emulsion to be used in the present invention, various kinds of compounds or their precursors can be added for the purpose of preventing fog occurred during manufacturing processes, storage or photographic processing, or for the purpose of stabilizing photographic properties. For specific examples of these compounds, compounds described in the above-cited Japanese Patent Application Laid Open No. 215272/1987, pp. 39 to 72 are preferably used. Further, 5-arylamino-1,2,3,4-thiatriazole compounds (the aryl group has at least one electron-attractive group) described in European Patent 0447647 are also preferably used.

Further, in order to improve the preservation property of the silver halide emulsion of the present invention, the following compounds can also preferably used in the present invention: hydroxam derivatives described in Japanese Patent Application Laid Open No. 109576/1999; ring type ketones [particularly, those represented by General Formula (S 1) and in paragraph number 0036 to 0071 can be included in the specification of the present invention] having a double bond the both ends of which are substituted by amino groups or hydroxyl groups adjacent to a carbonyl group described in Japanese Patent Application Laid Open No. 327094/1999; sulfo-substituted catechols and hydroquinones (e.g., 4,5-dihydroxy-1,3-benzenesulfonic acid, 2,5-dihydroxy-1,4-benzene sulfonic acid, 3,4-dihydroxybenzene sulfonic acid, 2,3-dihydroxybenzene sulfonic acid, 2,5-dihydroxybenzene sulfonic acid, 3,4,5-trihydroxybenzene sulfonic acid and their salts) described in Japanese Patent Application Laid Open No. 143011/1999; and water-soluble reducing agents represented by General Formula (I) to (III) in Japanese Patent Application Laid Open No. 102045/1999.

The emulsion for each layer of the photosensitive material of the present invention is subjected to spectral sensitization for the purpose of giving to the emulsion a spectral sensitivity in a desired light wavelength region.

In the photosensitive material of the present invention, as examples of spectral sensitizing dyes used for spectral sensitization in blue, green and red regions, compounds described in F. M. Harmer, *Heterocyclic compounds—Cyanine dyes and related compounds*, John Wiley & Sons, 1964 can be exemplified. Specific examples of the compounds and spectral sensitization methods described in the above-described Japanese Patent Application Laid Open No. 215272/1987 are preferably used. Further, as a red sensitive spectral sensitizing dye particularly for silver halide emulsion grains having a high content ratio of silver chloride, spectral sensitizing dyes described in Japanese Patent Application Laid Open No. 123340/1991 are very preferable in viewpoint of stability, strength of adsorption and temperature dependency of exposure to light.

An addition amount of these spectral sensitizing dyes is in a broad range corresponding to a case, preferably in the range of from $0.5\times10^{-6}$ mol to $1.0\times10^{-2}$ mol per 1 mol of silver halide, and more preferably in the range of from $1.0\times10^{-6}$ mol to $5.0\times10^{-3}$ mol.

The silver halide emulsions to be used in the present invention are usually chemically sensitized. As a chemical sensitization method, sulfur sensitization a representative of which is addition of a labile sulfur compound, noble metal sensitization a representative of which is gold sensitization, or reduction sensitization can be used solely or in combination.

For a compound employable in chemical sensitization, compounds described in Japanese Patent Application Laid Open No. 215272/1987, pp. 18 right lower column to pp. 22 right upper column are preferably used. Among these emulsions, an emulsion sensitized with gold sensitization is particularly preferable, since the variation of photographic properties can furthermore be reduced in case of being exposed by scanning with a laser light.

For sensitizing the silver halide emulsion to be used in the present invention with gold sensitization, it is preferred to utilize various kinds of inorganic gold compounds, gold (I) complexes having an inorganic ligand and gold (I) compounds having an organic ligand. It is preferred to use inorganic gold compounds, for example, chloroauric acid or its salts and gold (I) complexes having an inorganic ligand, for example, gold thiocyanate compounds such as potassium gold (I) dithiocyanate and gold dithiosulfate compounds such as trisodium gold (I) dithiosulfate.

Regarding gold (I) compounds having an organic ligand, it is preferable to use bis gold (I) mesoion heterocycles described in Japanese Patent Application Laid Open No. 267249/1992, for example, gold (I) tetrafluoroborate bis(1,4,5-trimethyl-1,2,4-triazolium-3-thiolate; organic mercapto gold (I) complexes described in Japanese Patent Application Laid Open No. 218870/1999, for example, potassium bis{1-[3-(2-sulfonate benzamide)phenyl]-5-mercaptotetrazole potassium salt}aurate (I) five hydrate; and gold (I) compounds having a nitrogen compound anion as a ligand described in Japanese Patent Application Laid Open No. 268550/1992, for example, sodium bis(1-methylhydantoinate aurate (I) four hydrate. Further, compounds in the following are also preferably used: gold (I) thiolate compounds described in U.S. Pat. No. 3,503,749; gold compounds described in Japanese Patent Application Laid Open Nos. 69074/1996, 69075/1996 and 269554/1997; and compounds described in U.S. Pat. Nos. 5,620,841, 5,912,112, 5,620,841, 5,939,245 and 5,912,111.

A preferable addition amount of these compounds may vary in a broad range corresponding to a case, and is in the range of from $5\times10^{-7}$ mol to $5\times10^{-3}$ mol per 1 mol of silver halide, and preferably in the range of from $5\times10^{-6}$ mol to $5\times10^{-4}$ mol.

Further, use of colloidal gold sulfide is also preferable. The manufacturing methods are described in *Research Disclosure*, 37154, *Solid State Ionics*, 79, pp. 60 to 66, 1995 and *Compt. Rend. Hebt. Seances Acad. Sci. Sect. B*, 263, pp. 1328, 1966. As colloidal gold sulfide, those in various sizes can be utilized. It is preferred to use colloidal gold sulfide having a diameter of 50 nm or less. An addition amount of colloidal gold sulfide may vary in a broad range corresponding to a case, but is preferably in the range of from $5\times10^{-7}$ mol to $5\times10^{-3}$ mol in terms of gold atom per 1 mol of silver halide, and more preferably in the range of from $5\times10^{-6}$ mol to $5\times10^{-4}$ mol.

In the present invention, gold sensitization may be combined with other sensitization methods, for example, sulfur sensitization, selenium sensitization, tellurium sensitization, reduction sensitization or noble metal sensitization except gold compounds.

For the silver halide photographic photosensitive material of the present invention, materials and additives for photographic use well-known can be used. For example, a transmitting-type support or a reflecting-type support can be used as a support for photographic use. For a transmitting-type support, a transparent film such as a cellulose nitrate film and a polyethylene terephthalate film, further, a polyester film made from 2,6-naphthalene dicarboxylic acid (NDCA) and ethylene glycol (EG), and a polyester film comprising NDCA, terephthalic acid and EG coated with a magnetic layer as an information recording layer are preferably used. For a reflecting-type support, preferred is a reflective support laminated with a plurality of polyethylene layers and polyester layers and containing a white pigment such as titanium oxide in at least one of these water-resistive resin layers (laminated layers).

For more preferable reflective supports in the present invention, those supports having a polyolefin layer with micro holes on the silver halide emulsion layer coating side of a paper substrate are exemplified. The polyolefin layer may comprise multi-layers. In this case, the multi-layers preferably comprise a polyolefin layer having no micro hole (e.g., polypropylene or polyethylene) adjacent to a gelatin layer on the silver halide emulsion layer side and more preferably a polyolefin layer having micro holes (e.g., polypropylene or polyethylene) on the side closer to the paper substrate. A density of a polyolefin layer of multi-layers or a single layer positioned between the paper substrate and a photographic constitution layer is preferably in the range of from 0.40 g/ml to 1.0 g/ml, and more preferably in the range of from 0.50 g/ml to 0.70 g/ml. Further, a thickness of a polyolefin layer of multi-layers or a single layer positioned between the paper substrate and a photographic constitution layer is preferably in the range of from 10 $\mu$m to 100 $\mu$m, and more preferably in the range of from 15 $\mu$m to 70 $\mu$m. Further, a thickness ratio of a polyolefin layer to a paper substrate is preferably in the range of from 0.05 to 0.2, and more preferably in the range of from 0.1 to 0.5.

Further, from the viewpoint of enhancing rigidity of the reflective support, it is preferable that a polyolefin layer is provided on the opposite side (back surface) to the photographic constitution layer of the paper substrate. In this case, the polyolefin layer is preferably polyethylene or polypropylene with a matted surface, and more preferably polypropylene. A thickness of the polyolefin layer on the back surface is preferably in the range of from 5 $\mu$m to 50 $\mu$m, and more preferably in the range of from 10 $\mu$m to 30 $\mu$m. Further, a density of the polyolefin layer is preferably in the range of from 0.7 g/ml to 1.1 g/ml. In the reflective support of the present invention, preferable conditions regarding the polyolefin layer provided on the paper substrate are referred to examples described in Japanese Patent Application Laid Open Nos. 333277/1998, 333278/1998, 52513/1999 and 65024/1999, and European Patents 0880065 and 0880066.

Further, it is preferred that a fluorescent whitening agent (i.e., a brightening agent) is contained in the water-resistive resin layer. The fluorescent whitening agent may be dispersed in a hydrophilic colloid layer of the photosensitive material. For the fluorescent whitening agent, a benzoxazole-based, a coumarin-based and a pyrazoline-based fluorescent whitening agents can be used. More preferably used are a benzoxazolyl naphthalene-based and a benzoxazolyl stilbene-based fluorescent whitening agents. A use amount of these fluorescent whitening agents is not particularly limited, but is preferably in the range of from 1 mg/m$^2$ to 100 mg/m$^2$. When the fluorescent whitening agent is mixed into the water-resistive resin, a mixing ratio thereof is preferably in the range of from 0.0005 wt % to 3 wt % based on the resin, and more preferably in the range of from 0.001 wt % to 0.5 wt %.

The reflecting-type supports may be those having a hydrophilic colloid layer containing a white pigment coated on the transmitting-type support or on the reflecting-type support as described above. Further, the reflecting-type support may be a support having a metallic surface with a mirror-like reflectivity or with the secondary diffusion reflectivity.

For the support to be used in the photosensitive material of the present invention, a white polyester type support for display use and a support on which a white pigment-containing layer is provided on the side having the silver halide emulsion layer may also be used. Further, in order to improve sharpness, it is preferred to coat an anti-halation layer on the silver halide emulsion layer-coating side or on the back side of the support. In particular, it is preferable to set a transmission density of the support in the range of from 0.35 to 0.8 so that a display can be enjoyed with either of reflected light or transmitted light.

To the photosensitive materials of the present invention, for the purpose of improving sharpness of an image, a decolorizable dye (an oxonol-based dye above all) is preferably added so that an optical reflection density of the photosensitive material becomes 0.70 or more at 680 nm, or titanium oxide which is surface-treated with 2- to 4-valence alcohols (e.g., trimethylol ethane) is preferably contained in the water-resistive resin layer of the support in an amount of 12 wt % or more (more preferably 14 wt % or more).

To the photosensitive materials of the present invention, for the purpose of preventing halation and irradiation or improving safety to a safe light, a dye (an oxonol-based dye or a cyanine dye above all) possible to be decolorized by processing is preferably added to the hydrophilic colloid layer as described in European Patent 0337490A2. Further, dyes described in European Patent 0819977 are also preferably used in the present invention.

Some of these water-soluble dyes make color separation and safety to a safe light worse when the use amount thereof is increased. For a dye which can be used without making color separation worse, water-soluble dyes described in Japanese Patent Application Laid Open Nos. 127324/1993, 127325/1993 and 216185/1993 are preferable.

In the present invention, a decolorizable colored layer in processing is used instead of a water-soluble dye or in combination use with a water-soluble dye. The colored layer decolorizable in processing to be used may contact the emulsion layer directly or may be arranged to contact via an intermediate layer containing gelatin and a processing color mixing inhibitor such as hydroquinone. This colored layer is preferably positioned as a lower layer (closer to the support) relative to the emulsion layer which generates the same kind of a primary color as the colored color. It is possible that all of each colored layer corresponding to each primary color are individually provided or that only a part of these layers is optionally selected and provided. Further, it is also possible that a colored layer so colored as to correspond to plural primary color regions is provided. Regarding an optical reflection density of the colored layer, an optical density value at a wavelength showing the highest optical density in a wavelength region (a visible light region from 400 nm to 700 nm in case of usual printer exposure, or the wavelength of a scanning exposure light source in case of scanning exposure) used for exposure is preferably from 0.2 to 3.0, more preferably from 0.5 to 2.5, and in particular, preferably from 0.8 to 2.0 or.

In order to form the colored layer, methods well-known can be applied. For example, the following methods are exemplified: methods in which dyes in a state of solid fine particle dispersion are included in a hydrophilic colloid layer as dyes described in Japanese Patent Application Laid Open No. 282244/1990, pp. 3 right upper column to pp. 8 and dyes described in Japanese Patent Application Laid Open No. 7931/1991, pp. 3 right upper column to pp. 11 left lower column; methods in which an anionic dye is used as a mordant dye to a cationic polymer; methods in which a dye adsorbs on fine grains such as a silver halide to be held in a layer; and methods in which colloidal silver is used as described in 239544/1989. As a method of dispersing fine particles of a dye in a solid state, for example, methods of incorporating fine particles of a dye which is at least substantially water-insoluble at pH 6 or less and at least substantially water-soluble at pH 8 or more are described in Japanese Patent Application Laid Open No. 308244/1990, pp. 4 to 11. Further, methods of using an anionic dye as a mordant dye to a cationic polymer are, for example, described in Japanese Patent Application Laid Open No. 84637/1990, pp. 18 to 26. Preparation methods of colloid silver as a light absorbing agent are described in U.S. Pat. Nos. 2,688,601 and 3,459,563. Among these methods, methods of incorporating fine particles of a dye and methods using colloidal silver are preferred.

The silver halide photographic photosensitive material of the present invention is used for a photographic color negative film, a photographic color positive film, a photographic color reversal film, a photographic color reversal printing paper and a photographic color printing paper, and preferably for a color paper among these.

It is preferable that the color paper comprises at least one layer for each of a yellow color forming silver halide emulsion layer, a magenta color forming silver halide emulsion layer and a cyan color forming silver halide emulsion layer. In general, these silver halide emulsion layers are positioned in the following order started by closer one to the support: a yellow color forming silver halide emulsion layer, a magenta color forming silver halide emulsion layer and a cyan color forming silver halide emulsion layer.

However, a different layer constitution from the foregoing layer constitution may be formed. The silver halide emulsion layer containing a yellow coupler may be arranged in any position on the support. However, in case that the yellow coupler-containing emulsion layer contains silver halide tabular grains, the yellow coupler-containing emulsion layer is preferably coated at a position more apart from the support than at least one layer of the magenta coupler-containing emulsion layer or the cyan coupler-containing emulsion layer.

Further, in viewpoints of color-forming development acceleration, desilvering acceleration and reduction of residual color caused by a sensitizing dye, the yellow coupler-containing silver halide emulsion layer is preferably coated at the position most apart from the support than other silver halide emulsion layers. Furthermore, in viewpoint of reduction of color fading caused by Blix, the cyan coupler-containing silver halide emulsion layer is preferably coated at the central position among other silver halide emulsion layers. In viewpoint of reduction of color fading caused by light, the cyan coupler-containing silver halide emulsion layer is preferably coated at the lowest position. Besides, each color forming layer of yellow, magenta and cyan may comprise two or three layers. For example, it is preferable that a coupler-containing layer containing no silver halide emulsion is provided as a color forming layer adjacent to the silver halide emulsion layer as described in Japanese Patent Application Laid Open Nos. 75055/1992, 114035/1997 and 246940/1998, and U.S. Pat. No. 5,576,159.

For silver halide emulsions, other materials (including additives) and photographic constitution layers (including layer arrangement) to be applied in the present invention as well as processing methods and additives for processing to be applied to treat these photosensitive materials, preferably used are those described in Japanese Patent Application Laid Open Nos. 215272/1987 and 33144/1990 and European Patent 0355660A2. In particular, those in European Patent 0355660A2 are preferred. Further, silver halide color photographic photosensitive materials and processing methods for them described in the following references are also preferable: Japanese Patent Application Laid Open Nos. 34889/1993, 359249/1992, 313753/1992, 270344/1992, 66527/1993, 34548/1992, 145433/1992, 854/1990, 158431/1989, 90145/1990, 194539/1991 and 93641/1990, and European Patent Laid-Open No. 0520457A2.

Particularly, in the present invention, regarding the reflecting-type support and the silver halide emulsion described above, and further, foreign metal ion species doped in silver halide grains, preservatives or anti-foggants for the silver halide emulsion, chemical sensitization methods (chemical sensitizers), spectral sensitization methods (spectral sensitizers), cyan, magenta and yellow couplers and emulsification dispersion methods for them, color image preservation-improving agents (stain prevention agents and anti-color fading agents), dyes (colored layers), gelatin species, layer-constitutions of photosensitive materials and film pH values of photosensitive materials, those described in patents shown in TABLE 1 and TABLE 2 can preferably be applied.

TABLE 1

| Element | JPALO 10448/1995 | JPALO 77775/1995 | JPALO 301895/1995 |
|---|---|---|---|
| Reflecting-Type Support | Column 7 Line 12 to Column 12 Line 19 | Column 35 Line 43 to Column 44 Line 1 | Column 5 Line 40 to Column 9 Line 26 |
| Silver Halide emulsion | Column 72 Line 29 to Column 74 Line 18 | Column 44 Line 36 to Column 46 Line 29 | Column 77 Line 48 to Column 80 Line 28 |
| Foreign Metal Ion Species | Column 74 Line 19 to Column 74 Line 44 | Column 46 Line 30 to Column 47 Line 5 | Column 80 Line 29 to Column 81 Line 6 |
| Preservatives or Anti-Foggants | Column 75 Line 9 to Column 75 Line 18 | Column 47 Line 20 to Column 47 Line 29 | Column 18 Line 11 to Column 31 Line 37 (Particularly, mercapto heterocyclic compounds) |
| Chemical Sensitization Methods (Chemical Sensitizers) | Column 74 Line 45 to Column 75 Line 6 | Column 47 Line 7 to Column 47 Line 17 | Column 81 Line 9 to Column 81 Line 17 |
| Spectral Sensitization Methods (Spectral Sensitizers) | Column 75 Line 19 to Column 76 Line 45 | Column 47 Line 30 to Column 49 Line 6 | Column 81 Line 21 to Column 82 Line 48 |
| Cyan Couplers | Column 12 Line 20 to Column 39 Line 49 | Column 62 Line 50 to Column 62 Line 16 | Column 88 Line 49 to Column 89 Line 16 |
| Yellow Couplers | Column 87 Line 40 to | Column 63 Line 17 to | Column 89 Line 17 |

TABLE 1-continued

| Element | JPALO 10448/1995 | JPALO 77775/1995 | JPALO 301895/1995 |
|---|---|---|---|
| | Column 88 Line 3 | Column 63 Line 30 | to Column 89 Line 30 |
| Magenta Couplers | Column 88 Line 4 to Column 88 Line 18 | Column 63 Line 3 to Column 64 Line 11 | Column 31 Line 34 to Column 77 Line 44 and Column 88 Line 32 to Column 88 Line 46 |
| Emulsification Dispersion Methods for Couplers | Column 71 Line 3 to Column 72 Line 11 | Column 61 Line 36 to Column 61 Line 49 | Column 87 Line 35 to Column 87 Line 48 |

JPALO: Japanese Patent Application Laid Open No.

TABLE 2

| Element | JPALO 10448/1995 | JPALO 77775/1995 | JPALO 301895/1995 |
|---|---|---|---|
| Color Image Storage-Improving Agent (Stain-Preventing Agent) | Column 39 Line 50 to Column 70 Line 9 | Column 61 Line 50 to Column 62 Line 49 | Column 87 Line 49 to Column 88 Line 48 |
| Anti-Color Fading Agent | Column 70 Line 10 to Column 71 Line 2 | | |
| Dye (Coloring Agent) | Column 77 Line 42 to Column 78 Line 41 | Column 7 Line 14 to Column 19 Line 42 and Column 50 Line 3 To Column 51 Line 14 | Column 9 Line 27 to Column 18 Line 10 |
| Gelatin Species | Column 78 Line 42 to Column 78 Line 48 | Column 51 Line 15 to Column 51 Line 20 | Column 83 Line 13 to Column 83 Line 19 |
| Layer Constitution of Photosensitive Material | Column 39 Line 11 to Column 39 Line 26 | Column 44 Line 2 to Column 44 Line 35 | Column 31 Line 38 to Column 32 Line 33 |
| Film pH of Photosensitive Material | Column 72 Line 12 to Column 72 Line 28 | | |
| Scanning Exposure | Column 76 Line 6 to Column 77 Line 41 | Column 49 Line 7 to Column 50 Line 2 | Column 82 Line 49 to Column 83 Line 12 |
| Preservative in Developing Solution | Column 88 Line 19 to Column 89 Line 22 | | |

JPLO: Japanese Patent Application Laid Open No.

In addition to the above, for cyan, magenta and yellow couplers to be used in the present invention, couplers described in the following references are also useful: Japanese Patent Application Laid Open No. 215272/1987, pp. 91 right upper column line 4 to pp. 121 left upper column line 6, Japanese Patent Application Laid Open No. 33144/1990, pp. 3 right upper column line 14 to pp. 18 left upper column last line and pp. 30 right upper column line 6 to pp. 35 right lower column line 11, and European Patent 0355660A2, pp. 4 line 15 to 27, pp. 5 line 30 to pp. 28 last line, pp. 45 line 29 to 31 and pp. 47 line 23 to pp. 63 line 50.

Further, in the present invention, compounds represented by General Formula (II) and (III) in WO-98/33760 and represented by General Formula (D) in Japanese Patent Application Laid Open No. 221825/1998 may preferably be added.

The present invention will be explained in more detail hereinafter. For cyan couplers employable in the present invention, pyrrolotriazole-based couplers are preferably used. Couplers represented by General Formula (I) or (II) in Japanese Patent Application Laid Open No. 313324/1993 and couplers represented by General Formula (I) in Japanese Patent Application Laid Open No. 347960/1994 as well as couplers described as examples in these references are particularly preferred. Further, phenol-based or naphthol-based cyan couplers are also preferable, for example, cyan couplers represented by General Formula (ADF) in Japanese Patent Application Laid Open No. 333297/1998 are preferable.

In addition to the couplers described in the above, pyrroloazole-based cyan couplers described in European Patents 0488248 and 0491197A1, 2,5-diacylaminophenol couplers described in U.S. Pat. No. 5,888,716, pyrazoloazole-based couplers having an electron-attractive group or a hydrogen bonding group at the 6-position described in U.S. Pat. Nos. 4,873,183 and 4,916,051 are preferable. In particular, pyrazoloazole-based couplers having an carbamoyl group at the 6-position described in Japanese Patent Application Laid Open Nos. 171185/1996, 311360/1996 and 339096/1996 are preferred.

Further, in addition to diphenylimidazole-based cyan couplers described in Japanese Patent Application Laid Open No. 33144/1990, 3-hydroxypyridine-based cyan couplers [above all, a coupler which is a two equivalent coupler converted by incorporating a chlorine-releasing group into Coupler (42) which is a four equivalent coupler, Coupler (6) and Coupler (9) enumerated as specific examples are particularly preferred] described in European Patent 0333185A2, ring-like active methylene-based cyan couplers (above all, Coupler Examples 3, 8 and 34 enumerated as specific examples are particularly preferred) described in Japanese Patent Application Laid Open No. 32260/1989, pyrrolopyrazole-based cyan couplers described in European Patent 0456226A1, and pyrroloimidazole-based cyan couplers described in European Patent 0484909 can also be used.

For magenta couplers employable in the present invention, 5-pyrazolone-based magenta couplers and pyrazoloazole-based magenta couplers as described in well-known literatures in the tables are used. Among them, use of the following magenta couplers is preferable from viewpoint of color hue, image stability and color forming property: pyrazolotriazole couplers in which a secondary or tertiary alkyl group is directly bonded at 2-, 3- or 6-position of a pyrazolotriazole ring as described in Japanese Patent Application Laid Open No. 65245/1986; pyrazoloazole couplers having a sulfonamide group in a molecule as described in Japanese Patent Application Laid Open No. 65246/1986; pyrazoloazole couplers having an alkoxyphenylsulfonamide balast group as described in Japanese Patent Application Laid Open No. 147254/1986; and pyrazoloazole couplers having an alkoxy group or an aryloxy group at 6-position as described in European Patents 226849A and 294785A. In particular, pyrazoloazole couplers represented by General Formula (M-I) described in Japanese Patent Application Laid Open No. 122984/1996 are preferable as magenta couplers. The content from paragraph number 0009 to 0026 of Japanese Patent Application Laid Open No. 122984/1996 is applied as it is to the present invention and of a part of the specification of the present invention. In addition to the above, pyrazoloazole couplers having steric hindrance groups at both of 3- and 6-positions described in European Patents 854384 and 884640 are also preferably used.

Further, for yellow couplers, in addition to compounds described in the above tables, acylacetamide-based yellow couplers having a 5- or 6-membered ring structure at an acyl group described in European Patent 0447969A1, malondianilide-based yellow couplers having a ring structure described in European Patent 0482552A1, and acylacetamide-based yellow couplers having a dioxane structure described in U.S. Pat. No. 5,118,599 are preferably used. Among them, acylacetamide-based yellow couplers in which the acyl group is a 1-alkylcyclopropane-1-carbonyl group and malondianilide-based yellow couplers in which one of two anilides forms an indoline ring are particularly preferred. These couplers can be used in a single kind or in combination.

Couplers to be used in the present invention are preferably emulsification-dispersed into a hydrophilic colloid aqueous solution by impregnating in a loadable latex polymer (described in U.S. Pat. No. 4,203,716) in the presence of a high boiling point organic solvent described in the above tables, or by dissolving together with a water-insoluble and organic solvent-soluble polymer. For the water-insoluble and organic solvent-soluble polymer which can preferably be used, homopolymers and copolymers described in U.S. Pat. No. 4,857,449, column 7 to 15 and WO88/00723 (International Patent Laid-Open No. 00723/1988) are exemplified. In viewpoint of color image stability, use of a methacrylate-based or an acrylamide-based polymer is more preferable, and use of the acrylamide-based polymer is particularly preferable.

In the present invention, well-known color mixing-preventing agents can be used. Among them, those described in the following references are preferable. For example, redox compounds with a high molecular weight described in Japanese Patent Application Laid Open No. 333501/1993; phenidone and hydrazine type compounds described in WO98/33760 and U.S. Pat. No. 4,923,787; and white couplers described in Japanese Patent Application Laid Open Nos. 249637/1993 and 282615/1998 and German Patent Application 19629142A1 can be used. Further, in particular, when development is accelerated by raising a pH value of a developing solution, redox compounds described in German Patent Application 19618786A1, European Patent Applications. 839623A1 and 842975A1, German Patent Application 19806846A1 and French Patent Application 2760460A1 are also preferably used.

In the present invention, compounds having a triazine structure which has a high molar absorption coefficient are preferably used as a ultraviolet light absorber. For example, compounds described in the following references can be used: Japanese Patent Application Laid Open Nos. 3335/1971, 152776/1980, 197074/1993, 232630/1993, 307232/1993, 211813/1994, 53427/1996, 234364/1996, 239368/1996, 31067/1997, 115898/1998, 147577/1998 and 182621/1998, German Patent 19739797A, European Patent 711804A and International Patent Publication No. 501291/1996.

For a binder or a protective colloid employable in the photosensitive material of the present invention, gelatin has an advantage to be used. However, other hydrophilic colloids can be used in a single kind or in combination with gelatin. In preferable gelatin, heavy metals contained as impurities such as iron, copper, zinc and manganese are preferably 5 ppm or less, and more preferably 3 ppm or less.

Further, a calcium content contained in the photosensitive material is preferably 20 mg/m$^2$ or less, more preferably 10 mg/m$^2$ or less, and most preferably 5 mg/m$^2$ or less.

In the present invention, in order to prevent various kinds of molds and bacteria which propagate in the hydrophilic colloid and degrade the image quality, biocides as described in Japanese Patent Application Laid Open No. 271247/1988 are preferably added.

A film surface pH of the photosensitive material is preferably in the range of from 4.0 to 7.0, and more preferably from 4.0 to 6.5.

In the present invention, from viewpoint of improving coating stability, of preventing static charge generation and of controlling an amount of electrification, a surfactant can be added to the photosensitive material. Examples of the surfactant include anion-based surfactants, cation-based surfactants, betain-based surfactants and nonion-based surfactants. For example, those described in Japanese Patent Application Laid Open No. 333492/1993 are exemplified. For the surfactant to be used in the present invention, a surfactant containing a fluorine atom is preferred. In particular, a fluorine atom-containing surfactant can preferably be used.

An addition amount of these surfactants to the photosensitive material is not particularly limited, but generally in the range of from $1\times10^{-5}$ g/m$^2$ to 1 g/m$^2$, preferably in the range of from $1\times10^{-4}$ g/m$^2$ to $1\times10^{-1}$ g/m$^2$, and more preferably in the range of from $1\times10^{-3}$ g/m$^2$ to $1\times10^{-2}$ g/m$^2$.

These fluorine atom-containing surfactants may be used in a single kind or in combination with other surfactants well-known and are preferably used in combination with other well-known surfactants.

The photosensitive material of the present invention suits to a scanning exposure system using a cathode ray tube (CRT) in addition to being used in a print system using an ordinary negative printer. A cathode ray tube exposure apparatus is simpler, more compact and lower cost in comparison to an apparatus using a laser. Further, it is easy to make adjustment of a light axis and colors.

In the cathode ray tube to be used for image exposure, various kinds of light emitters giving light emission in the spectral region corresponding to needs are used. For example, any one kind of a red light emitter, a green light emitter and a blue light emitter is used, or two or more kinds in combination are used. The spectral region is not limited in red, green or blue described above, but fluorescent substance giving light emission in a yellow, orange, purple or infrared region is also used. In particular, a cathode ray tube emitting white light by using a mixture of these light emitters is frequently used.

In case that the photosensitive material has a plurality of photosensitive layers each having a different spectral sensitivity distribution and the cathode ray tube also has fluorescent substance giving light emission in a plurality of spectral regions, a plurality of colors may be exposed simultaneously, namely, image signals of a plurality of colors may be input into the cathode ray tube to emit light from the tube face. A method in which image signals of each color are input in sequence to make sequential light emission for each color and to make exposure through a film which cuts colors except the color (a sequential exposure) may be adopted. In general, the sequential exposure is preferable for obtaining higher image quality because a cathode ray tube of higher resolution can be used for the sequential exposure.

For the photosensitive material of the present invention, preferably used is a digital scanning exposure system using a monochromatic high density light such as a gas laser, a light emitting diode, a semiconductor laser and the second harmonic wave-generating light source (SHG) in combination of a non-linear optical crystal with a semiconductor laser or a solid laser using a semiconductor laser as an exciting light source.

It is preferred that the semiconductor laser or the second harmonic wave-generating light source (SHG) in combination of a non-linear optical crystal with the semiconductor laser or the solid laser is used to make the system compact and low cost.

Particularly, it is preferable to use the semiconductor laser for designing a compact and low cost system further with a long life and high stability. It is preferred to use the semiconductor laser for at least one exposure light source.

When such a scanning exposure light source is used, the maximum wavelength of spectral sensitivity of the photosensitive material of the present invention can optionally be established according to the wavelength of a light source for scanning exposure. With the second harmonic wave-generating light source (SHG) obtained in combination of the non-linear optical crystal with the semiconductor laser or the solid laser using the semiconductor laser as the exciting light source, blue light or green light can be obtained because an oscillating wavelength of the laser can be made to a half of it. Accordingly, the maximum wavelength of spectral sensitivity of the photosensitive material is possible to be established in the normal three wavelength regions of blue, green and red. An exposure time in such a scanning exposure is, under the definition that the exposure time is a time to expose a pixel size in assuming a pixel density as 400 dpi, preferably $10^{-4}$ seconds or less, and more preferably $10^{-6}$ seconds or less.

Preferable scanning exposure systems applicable to the present invention are described in detail in the references indicated in the foregoing tables.

Further, in order to process the photosensitive material of the present invention, processing materials and processing methods described in Japanese Patent Application Laid Open No. 207250/1990, pp. 26 right lower column line 1 to pp. 34 right upper column line 9 and Japanese Patent Application Laid Open No. 97355/1992, pp. 5 left upper column line 17 to pp. 18 right lower column line 20 can preferably be applied. Besides, as a preservative to be used in these developing solutions, compounds described in the references indicated in the foregoing tables are preferably used.

The present invention is preferably applied to even a photosensitive material having aptitude to rapid processing.

A color development time means a time since the photosensitive material enters into a color developing solution till it enters into a blix (bleach and fix) solution as the second processing procedure. For example, in case of processing with an automatic processor, the sum of both of a time when the photosensitive material is dipped in the color developing solution (the so-called time in liquid) and a time when the photosensitive material leaves the color developing solution and is carried in air toward the blix solution as the next processing procedure (the so-called time in air) is defined as a color development time. In the same manner, a blix time means a time since the photosensitive material enters into a blix solution till it enters into the next washing or stabilizing bath. Further, a washing or stabilizing time means a time since the photosensitive material enters into the washing or stabilizing solution till it leaves toward a drying process (the so-called time in liquid).

When a rapid processing is conducted in the present invention, a color development time is preferably 60 seconds or less, more preferably from 6 to 50 seconds, and furthermore preferably from 6 to 30 seconds. In the same manner, a blix time is preferably 60 seconds or less, more preferably from 6 to 50 seconds, and furthermore preferably from 6 to 30 seconds. Further, a washing or stabilizing time is preferably 150 seconds or less, and more preferably from 6 to 130 seconds.

For a method of developing the photosensitive material of the present invention after exposure, in addition to wet systems such as methods of developing with a developing solution containing conventional alkali agents and developing agents and methods of developing with an activator solution such as an alkaline solution containing no developing agent, heat development systems without using processing solutions can be used.

In particular, an activator method is easy to manage and handle processing solutions because no developing agent is contained in processing solutions. Further, the activator method is a preferable method in viewpoint of the protection of the environment because of less loading when waste is treated.

Examples of the developing agent or its precursor incorporated into the photosensitive material in the activator method preferably include hydrazine-based compounds described in Japanese Patent Application Laid Open Nos. 234388/1996, 152686/1997, 152693/1997, 211814/1997 and 160193/1997.

Further, preferably used is a developing method in which an image-amplifying treatment (intensification treatment) is performed with hydrogen peroxide for a photosensitive material having a reduced coated silver amount. Particularly, it is preferred to use this method for the activator method. Specifically, image formation methods using an activator solution containing hydrogen peroxide as described in Japanese Patent Application Laid Open Nos. 297354/1996 and 152695/1997 are preferably used. In the activator method, a desilvering process is usually performed after a treatment with the activator solution. However, in case of the image-amplifying treatment method using the photosensitive material having a low silver content, a simple method can be conducted, in which a desilvering process is omitted before a washing or stabilizing process. Further, in a system to read image information with a scanner out of the photosensitive material, a processing form without a desilvering process can be adopted even in case of using a photosensitive material having a high silver content such as photosensitive materials for taking a photograph.

For processing materials in the activator solution, in the desilvering solution (bleach/fix solution), and in the washing and stabilizing solution and for processing methods to be used in the present invention, well-known materials and methods can be used. Those described in *Research Disclosure*, Item 36544, September 1994, pp. 536 to 541 and Japanese Patent Application Laid Open No. 4388/1996 can be used.

When the photosensitive material of the present invention is exposed with a printer, it is preferable to use a band-stop filter described in U.S. Pat. No. 4,880,726. Owing to the filter, light-color mixing is eliminated to improve color reproducibility remarkably.

In the present invention, as described in European Patents 0789270A1 and 0789480A1, copying regulation may be performed by pre-exposing yellow micro-dot pattern preliminarily before giving image information.

EXAMPLE

The present invention will be further described in the following EXAMPLES 1 to 4, however the present invention should not be construed as being limited thereto.

Example 1

Emulsion 1-1

Preparation of Silver Chloride Cube Sample (1) (Comparative Example)

To a 5% aqueous solution of lime-treated gelatin, 5.6 g of sodium chloride, 42.8 mL of 1N sulfuric acid and 1.1 mL of a 1% aqueous solution of N,N'-dimethylimidazolidine-2-thione were added. To this aqueous solution, 241.2 mL of an aqueous solution containing 0.21 mol of silver nitrate and 241.2 mL of an aqueous solution containing 0.21 mol of sodium chloride were added during 24 minutes at 61° C. while being stirred. Subsequently, to the foregoing mixture, 720 mL of an aqueous solution containing 1.91 mol of silver nitrate and 720 mL of an aqueous solution containing 1.91 mol of sodium chloride were added during 40 minutes maintained at 61° C. while being stirred. Thus, cubic grains having an average grain size of 0.62 $\mu$m (variation coefficient: 10%) were obtained. Then, the resulting silver chloride emulsion was treated in precipitation and washing processes to be desalted. Further, 168.0 g of lime-treated gelatin was added to the emulsion. The pH and the pAg of the emulsion were adjusted to 7.3 and 5.6 respectively. To the emulsion, a gold sensitizer [gold (I) tetrafluoroborate bis(1,4,5-trimethyl-1,2,4-triazolium-3-thiolate)] was added in an amount of $1.5\times10^{-5}$ mol per 1 mol of silver, a sulfur sensitizer (sodium thiosulfate) was added in an amount of $6\times10^{-7}$ mol per 1 mol of silver, and further, blue sensitive spectral sensitizing dyes (A & B) were added in an amount of $2.3\times10^{-4}$ mol and $1.5\times10^{-4}$ mol respectively per 1 mol of silver. The emulsion was optimally treated at 60° C. in chemical senstization and in spectral sensitization. Furthermore, 1-(5-methylureidophenyl)-5-mercaptoterazole was added in an amount of $4.4\times10^{-4}$ mol per 1 mol of silver, thereby Emulsion 1-1 was obtained.

Sensitizing Dye A:

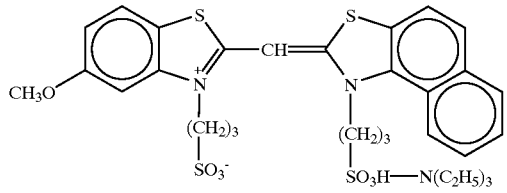

Sensitizing Dye B:

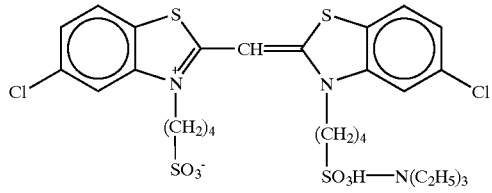

Emulsion 1-2

Preparation of Silver Chloride Cube Sample Doped with Complexes in Class A, Class B and Class C (Comparative Example)

Emulsion 1-2 was prepared in the same manner as that in Emulsion 1-1 except that pentachloronitrosyl ruthenium as a transition metal complex in Class A in an amount of $1\times10^{-8}$ mol for the silver amount added to the emulsion in the layer ranged from 10% to 70% of the grain volume counted from the center part, hexachloro iridium as a transition metal complex in Class B in an amount of $4\times10^{-8}$ mol for the silver amount added in the emulsion in the layer ranged from 96% to 98% of the grain volume counted from the center part, and pentachloroaqua iridium as a transition metal complex in Class C in an amount of $2\times10^{-6}$ mol for the silver amount added to the emulsion in the layer ranged from 87% to 92% of the grain volume counted from the center part were respectively added to the emulsion of Emulsion 1-1.

Emulsion 1-3

Preparation of Silver Chloride Cube Sample Doped with Complexe in Class B and Class D (Comparative Example)

Emulsion 1-3 was prepared in the same manner as that in Emulsion 1-1 except that hexachloro iridium as a transition metal complex in Class B in an amount of $2\times10^{-6}$ mol for the silver amount added to the emulsion in the layer ranged from 87% to 97% of the grain volume counted from the center part, and hexacyano ruthenium as a transition metal complex in Class D in an amount of $2\times10^{-5}$ mol for the silver amount added in the emulsion in the layer ranged from 75% to 85% of the grain volume counted from the center part were respectively added to the emulsion of Emulsion 1-1, and further except that silver bromide fine particles doped with hexachloro iridium classified in Class B were added (hexachloro iridium was in an amount of $1.5\times10^{-6}$ mol for the entire silver amount of the emulsion) before chemical sensitization of Emulsion 1-1.

Emulsion 1-4

Preparation of Silver Chloride Cube Sample Doped with Complexes in Class A, Class B, Class C and Class D (Present Invention)

Emulsion 1-4 was prepared in the same manner as that in Emulsion 1-1 except that pentachloronitrosyl ruthenium as a transition metal complex in Class A in an amount of $1\times10^{-8}$ mol for the silver amount added to the emulsion in the layer ranged from 10% to 70% of the grain volume counted from the center part, hexachloro iridium as a transition metal complex in Class B in an amount of $4\times10^{-8}$ mol for the silver amount added to the emulsion in the layer ranged from 96% to 98% of the grain volume counted from the center part, pentachloroaqua iridium as a transition metal complex in Class C in an amount of $2\times10^{-6}$ mol for the silver amount added to the emulsion in the layer ranged from 87% to 92% of the grain volume counted from the center part, and hexacyano ruthenium as a transition metal complex in Class D in an amount of $2\times10^{-5}$ mol for the silver amount added to the emulsion in the layer ranged from 75% to 85% of the grain volume counted from the center part were respectively added to the emulsion of Emulsion 1-1.

Emulsion 1-5

Preparation of Silver Chloride Cube Sample Doped with Complexes in Class B, Class C and Class D (Present Invention)

Emulsion 1-5 was prepared in the same manner as that in Emulsion 1-1 except that pentachloroaqua iridium as a transition metal complex in Class C in an amount of $2\times10^{-6}$ mol for the silver amount added to the emulsion in the layer ranged from 87% to 97% of the grain volume counted from the center part and hexacyano ruthenium as a transition metal complex in Class D in an amount of $2\times10^{-5}$ mol for the silver amount added in the emulsion in the layer ranged from 75% to 85% of the grain volume counted from the center part were respectively added to the emulsion of Emulsion 1-1, and further except that silver bromide fine particles doped with hexachloro iridium classified in Class B were added (hexachloro iridium was in an amount of $1.5\times10^{-6}$ mol for the entire silver amount of the emulsion) before chemical sensitization of Emulsion 1-1.

Emulsion 1-6

Preparation of Silver Chloride Cube Sample Doped with Complexes in Class A, Class C and Class D (Present Invention)

Emulsion 1-6 was prepared in the same manner as that in Emulsion 1-1 except that pentachloronitrosyl ruthenium as a transition metal complex in Class A in an amount of $1\times10^{-8}$ mol for the silver amount added to the emulsion in the layer ranged from 10% to 70% of the grain volume counted from the center part, pentachloroaqua iridium as a transition metal complex in Class C in an amount of $4\times10^{-6}$ mol for the silver amount added to the emulsion in the layer ranged from 92% to 97% of the grain volume counted from the center part, and hexacyano ruthenium as a transition metal complex in Class D in an amount of $2\times10^{-5}$ mol for the silver amount added to the emulsion in the layer ranged from 75% to 85% of the grain volume counted from the center part were respectively added to the emulsion of Emulsion 1-1.

These emulsions were used in a photographic constitution layer. After a corona discharge treatment was performed on the surface of a support comprising both surfaces of paper coated with a polyethylene resin, a gelatin undercoat layer containing sodium dodecylbenzene sulfonate was provided on the support, and further, the first layer to the seventh layer were coated to form photographic constitution layers, thereby Sample (101) to (106) of a silver halide color photographic photosensitive material having the layer composition shown below were prepared.

The coating solutions for each photographic constitution layer were prepared as follows.

Preparation of First Layer Coating Solution 57 g of Yellow Coupler (ExY), 7 g of Color Image Stabilizer (Cpd-1), 4 g of Color Image Stabilizer (Cpd-2), 7 g of Color Image Stabilizer (Cpd-3) and 2 g of Color Image Stabilizer (Cpd-8) were dissolved in 21 g of Solvent (Solv-1) and 80 mL of ethyl acetate. This solution was emulsification-dispersed into 220 g of a 23.5 wt % gelatin aqueous solution containing 4 g of sodium dodecylbenzene sulfonate by means of a high speed agitation emulsifier (dissolver), and then water was added to prepare 900 g of Emulsified Dispersion A.

On the other hand, Emulsified Dispersion A and Emulsion 1-1 were dissolved and mixed so as to have the composition described later, thereby First Layer Coating Solution was prepared. A coated amount of an emulsion is expressed by a coated amount calculated in terms of silver.

Preparation of Second Layer to Seventh Layer Coating Solutions

Each coating solution for the second layer to the seventh layer was prepared in the same manner as that in First Layer Coating Solution. As a hardener for gelatin in each layer, sodium salt of 1-oxy-3,5-dichloro-s-triazine (H-1), (H-2) and (H-3) were used. Further, to each layer, Preservative (Ab-1), (Ab-2), (Ab-3) and (Ab-4) were added so as to obtain an entire amount of 15.0 mg/m$^2$, 60.0 mg/m$^2$, 5.0 mg/m$^2$ and 10.0 mg/m$^2$, respectively.

Hardener (H-1)

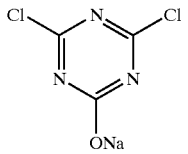

(Used Amount: 1.4 wt %/gelatin)

Hardener (H-2)

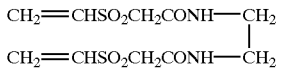

Hardener (H-3)

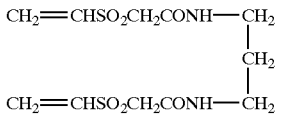

Preservative (Ab-1)

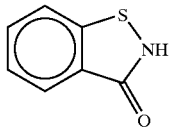

Preservative (Ab-2)

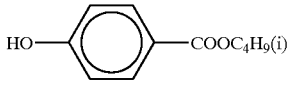

Preservative (Ab-3)

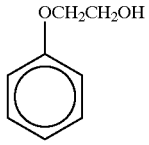

Preservative (Ab-4)

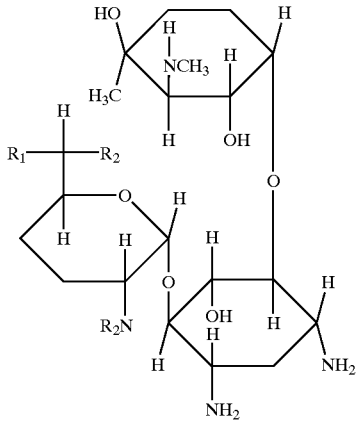

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture of a, b, c and d=1:1:1:1 (molar ratio).

For a silver chlorobromide emulsion in the green sensitive emulsion layer and the red sensitive emulsion layer, the following spectral sensitizing dyes were used respectively.

Green Sensitive Emulsion Layer

Sensitizing Dye D

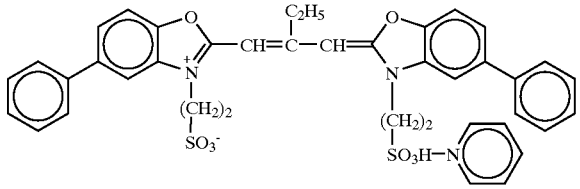

Sensitizing Dye E

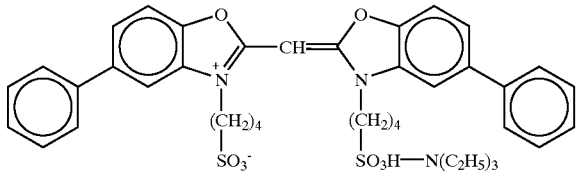

Sensitizing Dye F

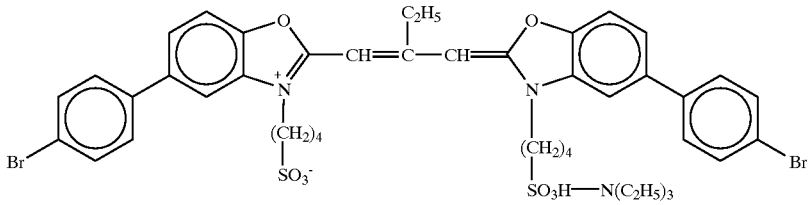

(Sensitizing Dye D was added in the amount of $3.0\times10^{-4}$ mol to a large grain size emulsion, and in the amount of $3.6\times10^{-4}$ mol to a small grain size emulsion, per 1 mol of silver halide. Sensitizing Dye E was added in the amount of $4.0\times10^{-5}$ mol to a large grain size emulsion, and in the amount of $7.0\times10^{-5}$ mol to a small grain size emulsion, per 1 mol of silver halide. Sensitizing Dye F was added in the amount of $2.0\times10^{-4}$ mol to a large grain size emulsion, and in the amount of $2.8\times10^{-4}$ mol to a small grain size emulsion, per 1 mol of silver halide.)

Red Sensitive Emulsion Layer

Sensitizing Dye G

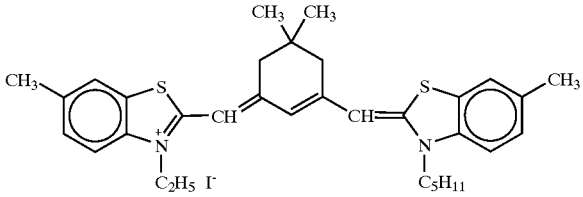

Sensitizing Dye H

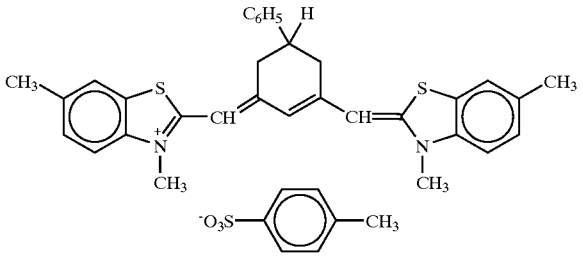

(Sensitizing Dye G and H were respectively added in the amount of $8.0\times10^{-5}$ mol to a large grain size emulsion, and in the amount of $10.7\times10^{-5}$ mol to a small grain size emulsion, per 1 mol of silver halide.)

Further, Compound I shown below was added to the red sensitive emulsion layer in the amount of $3.0\times10^{-3}$ mol per 1 mol of silver halide.

Compound I

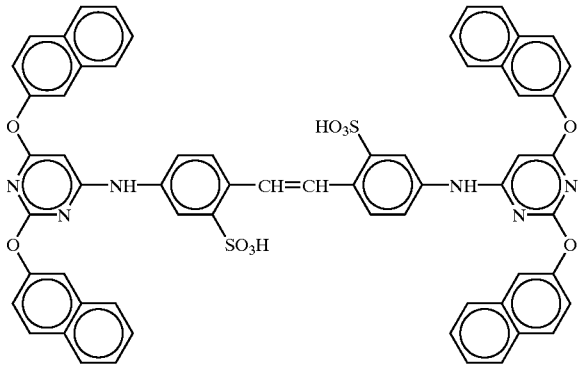

Also, to the green sensitive emulsion layer and to the red sensitive emulsion layer, 1-(3-methylureidophenyl)-5-mercaptotetrazole was added in an amount of $3.3\times10^{-4}$ mol, $1.0\times10^{-3}$ mol and $5.9\times10^{-4}$ mol, per 1 mol of silver halide, respectively. Further, to the second layer, the fourth layer, the sixth layer and the seventh layer, this compound was added so as to be in an amount of 0.2 mg/m$^2$, 0.2 mg/m$^2$, 0.6 mg/m$^2$ , and 0.1 mg/m$^2$, respectively.

Also, to the blue sensitive emulsion layer and to the green sensitive emulsion layer, 4-hydroxy-6-methyl-1,3,3a,7-tetraazaindene was added in an amount of $1\times10^{-4}$ mol and $2\times10^{-4}$ mol, per 1 mol of silver halide, respectively.

Also, to the red sensitive emulsion layer, a latex of a methacrylic acid/acrylic acid copolymer (weight ratio=1:1, average molecular weight: 200,000 to 400,000) was added in the amount of 0.05 g/m$^2$.

Also, to the second layer, the fourth layer and the sixth layer, disodium catechol-3,5-disulfonate was added so as to be in an amount of 6 mg/m$^2$, 6 mg/m$^2$ and 18 mg/m$^2$, respectively.

Also, the following dyes (a coated amount shown in a parenthesis) were added to prevent irradiation.

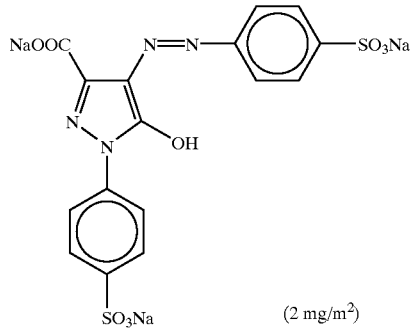

(2 mg/m$^2$)

-continued

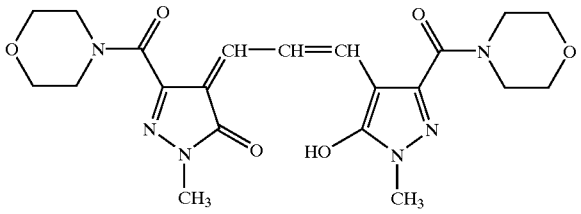

(2 mg/m$^2$)

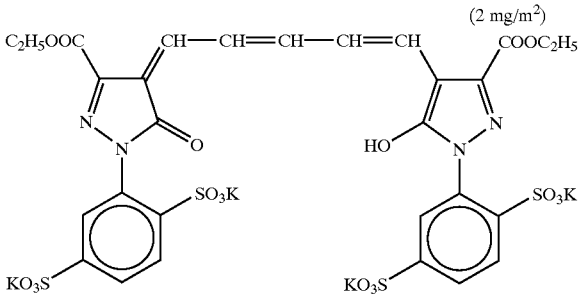

(3 mg/m$^2$)

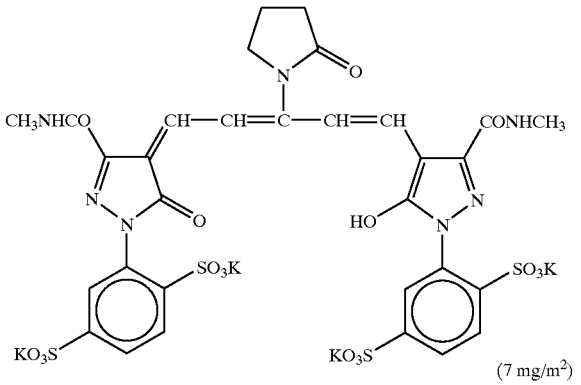

(7 mg/m$^2$)

Layer Constitution

The constitution of each layer will be described hereinafter. Numerals indicate a coated amount (g/m$^2$). In case of a silver halide emulsion, numerals indicate a coated amount calculated in terms of silver.

Support:

Polyethylene Resin-laminated Paper

{The polyethylene resin on the first layer side contains a white pigment ($TiO_2$; a content ratio of 16 wt %, ZnO; a content ratio of 4 wt %), a fluorescent whitening agent (i.e., a brightening agent) [4.4'-bis(5-methylbenzoxazolyl)stilbene; a content ratio of 0.03 wt %] and a bluing dye (ultramarine)}

| | |
|---|---|
| First Layer (Blue Sensitive Emulsion): | |
| Emulsion 1-1 | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| Second Layer (Color Mixing-Preventing Layer): | |
| Gelatin | 0.99 |
| Color Mixing-Preventing Agent (Cpd-4) | 0.09 |

-continued

| | |
|---|---|
| Color Image Stabilizer (Cpd-5) | 0.018 |
| Color Image Stabilizer (Cpd-6) | 0.13 |
| Color Image Stabilizer (Cpd-7) | 0.01 |
| Solvent (Solv-1) | 0.06 |
| Solvent (Solv-2) | 0.22 |
| Third Layer (Green Sensitive Emulsion Layer): | |
| Silver Chlorobromide Emulsion Em-1 [Cubic grains sensitized by gold and sulfur sensitization. A 1:3 (silver molar ratio) mixture of a large grain size emulsion having an average grain size of 0.45 μm and a small grain size emulsion having an average grain size of 0.35 μm. Variation coefficients of grain size distribution were 0.10 and 0.08 respectively. Both of each size emulsion were incorporated with silver iodide of 0.15 mol % near the grain surface and silver bromide of 0.4 mol % localized on the grain surface] | 0.14 |
| Gelatin | 1.36 |
| Magenta Coupler (ExM) | 0.15 |
| Ultraviolet Light Absorber (UV-A) | 0.14 |
| Color Image Stabilizer (Cpd-2) | 0.02 |
| Color Image Stabilizer (Cpd-4) | 0.002 |
| Color Image Stabilizer (Cpd-6) | 0.09 |
| Color Image Stabilizer (Cpd-8) | 0.02 |
| Color Image Stabilizer (Cpd-9) | 0.03 |
| Color Image Stabilizer (Cpd-10) | 0.01 |
| Color Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Mixing-Preventing Layer): | |
| Gelatin | 0.71 |
| Color Mixing-Preventing Agent (Cpd-4) | 0.06 |
| Color Image Stabilizer (Cpd-5) | 0.013 |
| Color Image Stabilizer (Cpd-6) | 0.10 |
| Color Image Stabilizer (Cpd-7) | 0.007 |
| Solvent (Solv-1) | 0.04 |
| Solvent (Solv-2) | 0.16 |
| Fifth Layer (Red Sensitive Emulsion Layer): | |
| Silver Chlorobromide Emulsion Em-2 [Cubic grains sensitized by gold and sulfur sensitization. A 5:5 (silver molar ratio) mixture of a large grain size emulsion having an average grain size of 0.40 μm and a small grain size emulsion having an average grain size of 0.30 μm. Variation coefficients of grain size distribution were 0.09 and 0.11 respectively. Both of each size emulsion were incorporated with silver iodide of 0.1 mol % near the grain surface and silver bromide of 0.8 mol % localized on the grain surface] | 0.12 |
| Gelatin | 1.11 |
| Cyan Coupler (ExC-2) | 0.13 |
| Cyan Coupler (ExC-3) | 0.03 |
| Color Image Stabilizer (Cpd-1) | 0.05 |
| Color Image Stabilizer (Cpd-6) | 0.06 |
| Color Image Stabilizer (Cpd-7) | 0.02 |
| Color Image Stabilizer (Cpd-9) | 0.04 |
| Color Image Stabilizer (Cpd-10) | 0.01 |
| Color Image Stabilizer (Cpd-14) | 0.01 |
| Color Image Stabilizer (Cpd-15) | 0.12 |
| Color Image Stabilizer (Cpd-16) | 0.03 |
| Color Image Stabilizer (Cpd-17) | 0.09 |
| Color Image Stabilizer (Cpd-18) | 0.07 |
| Solvent (Solv-5) | 0.15 |
| Solvent (Solv-8) | 0.05 |
| Sixth Layer (Ultraviolet Light-Absorbing Layer): | |
| Gelatin | 0.46 |

-continued

| | |
|---|---|
| Ultraviolet Light Absorber (UV-B) | 0.45 |
| Compound (S1-4) | 0.0015 |
| Solvent (Solv-7) | 0.25 |
| Seventh Layer (Protective Layer): | |
| Gelatin | 1.00 |
| Acryl-Modified Copolymer of Polyvinyl Alcohol (degree of modification: 17%) | 0.04 |
| Liquid paraffin | 0.02 |
| Surfactant (Cpd-13) | 0.01 |

Yellow Coupler (ExY):

A mixture (in the molar ratio of 70:30) of

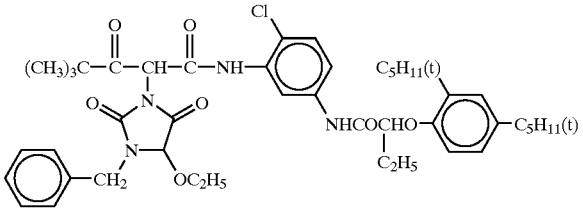

and

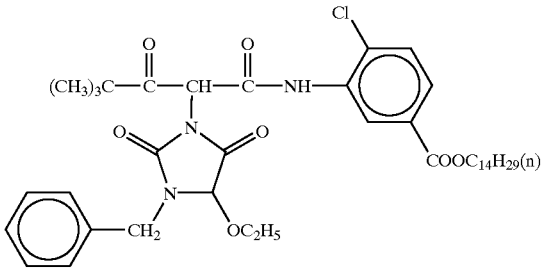

Magenta Coupler (ExM):

A mixture (in the molar ratio of 40:40:20) of

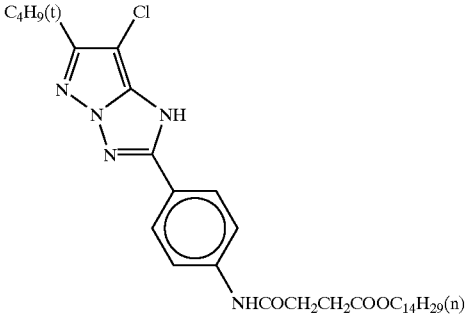

and

-continued

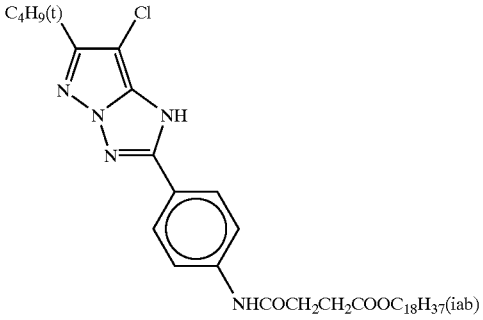

and

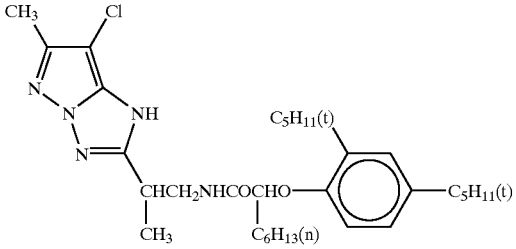

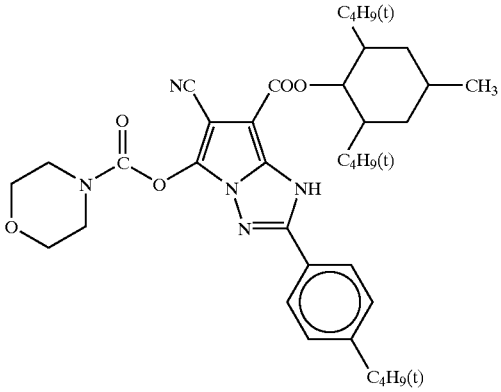

A mixture (in the molar ratio of 50:25:25) of

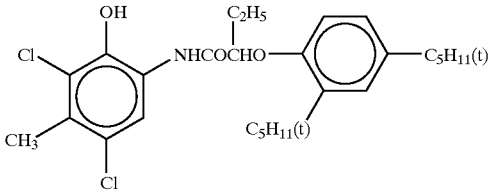

and

-continued

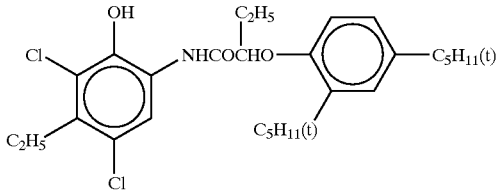

and

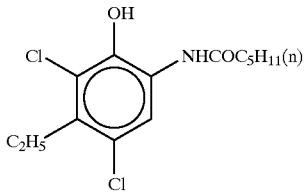

Color Image Stabilizer (Cpd-1):

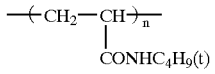

Number average molecular weight: 60,000

Color Image Stabilizer (Cpd-2):

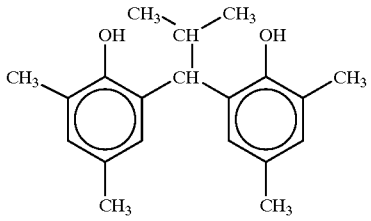

Color Image Stabilizer (Cpd-3):

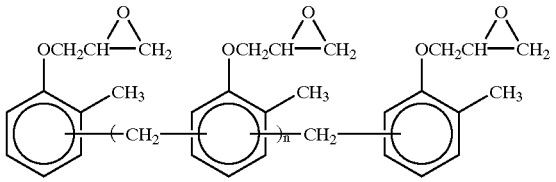

n=7 to 8 (average value)

Color Mixing-preventing Agent (Cpd-4):

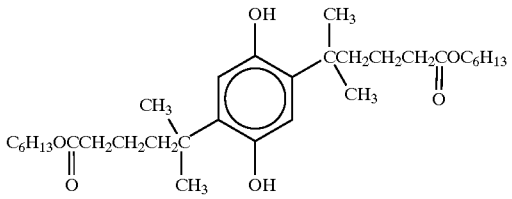

Color Image Stabilizer (Cpd-5):

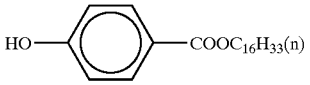

Color Image Stabilizer (Cpd-6):

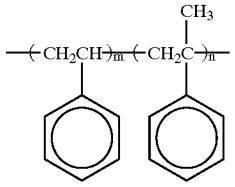

Number average molecular weight: 600 m/n=10/90

Color Image Stabilizer (Cpd-7):

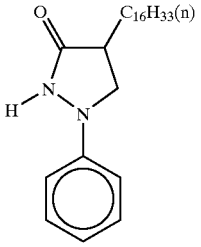

Color Image Stabilizer (Cpd-8):

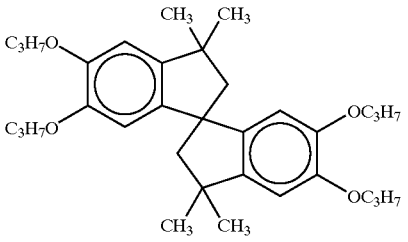

Color Image Stabilizer (Cpd-9):

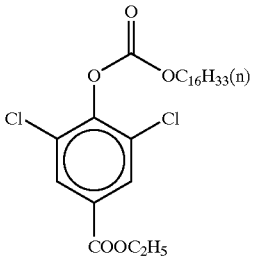

Color Image Stabilizer (Cpd-10):
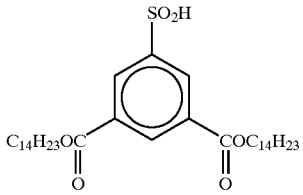
Color Image Stabilizer (Cpd-11):
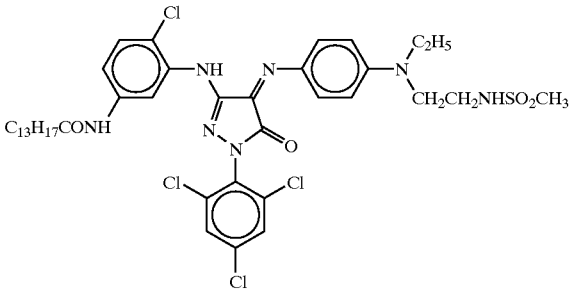
Surfactant (Cpd-13):
A mixture (in the molar ratio of 7:3) of
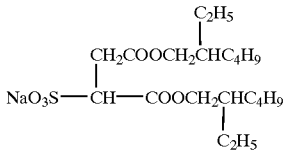
and
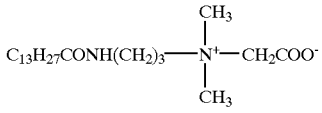
(Cpd-14):
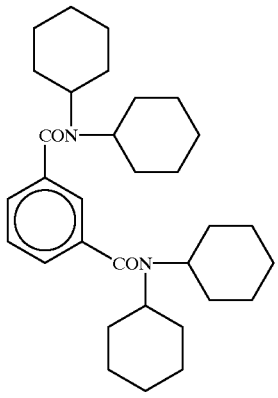
(Cpd-15):
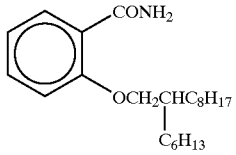
-continued
(Cpd-16):
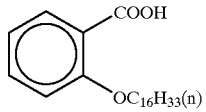
(Cpd-17):
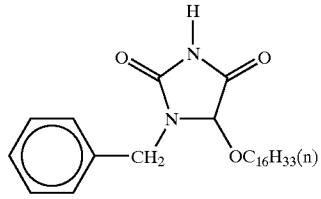
(Cpd-18)
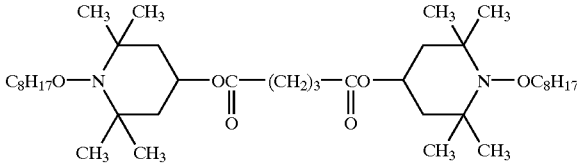
Color Mixing-preventing Agent (Cpd-19):
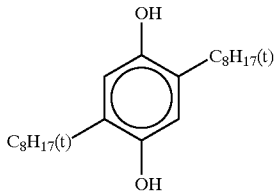
Ultraviolet Light Absorber (UV-1):
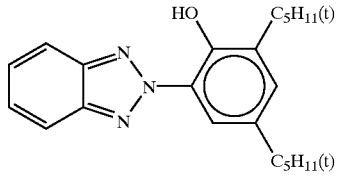
Ultraviolet Light Absorber (UV-2):
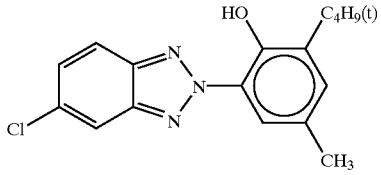
Ultraviolet Light Absorber (UV-3):
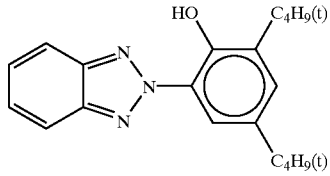

Ultraviolet Light Absorber (UV-4):

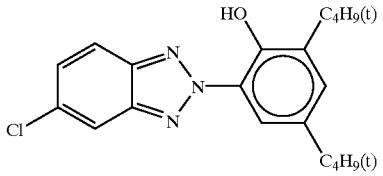

Ultraviolet Light Absorber (UV-5):

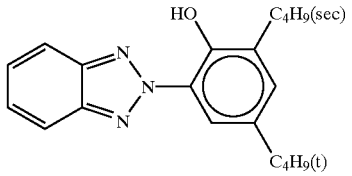

Ultraviolet Light Absorber (UV-6):

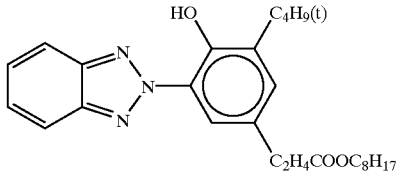

Ultraviolet Light Absorber (UV-7):

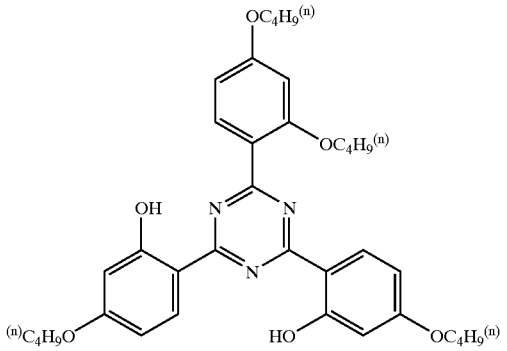

UV-A: A mixture of UV-1/UV-2/UV-3/UV-4=4/2/2/3 (ratio by weight)

UV-B: A mixture of UV-1/UV-2/UV-3/UV-4/UV-5/UV-6=9/3/3/4/5/3 (ratio by weight)

UV-C: A mixture of UV-2/UV-3/UV-6/UV-7=1/1/1/2 (ratio by weight)

(Solv-1)

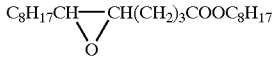

(Solv-2)

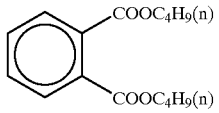

(Solv-3)

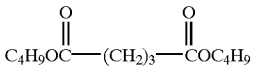

(Solv-4)

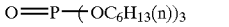

(Solv-5)

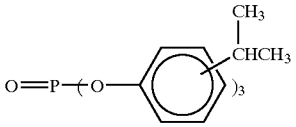

(Solv-7)

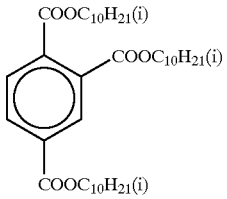

(Solv-8)

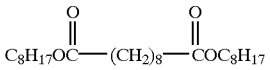

(S1-4)

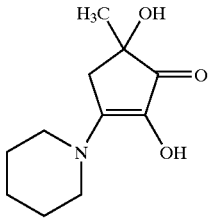

Sample (102) to (106) were prepared in the same manner as that in Sample (101), except that Emulsion 1-1 in Sample (101) was changed to Emulsion 1-2 to 1-6.

In order to investigate photographic properties of these samples, the following experiments were conducted.

Experiment 1: Sensitometry

Each coated sample was exposed to light with gradation for sensitometry by using a sensitometer (Model FHW manufactured by Fuji Photo Film Co., Ltd.). Each sample was exposed to low intensity light for 10 seconds through a SP-1 filter mounted.

Also, each coated sample was exposed to light with gradation for sensitometry by using a sensitometer for high intensity light (Model HIE manufactured by Yamashita Denso Co., Ltd.). Each sample was exposed to high intensity light for $10^{-4}$ seconds through a SP-1 filter mounted.

After being exposed to light, the color development processing described below was conducted.

The processing processes will be described hereinafter.

Processing A

The photosensitive material (101) described above was processed into a roll-form of 127 mm in width. By using a printer-processor for a mini-laboratory, Model PP1258AR, manufactured by Fuji Photo Film Co., Ltd., after being imagewise exposed to light, the photosensitive material (101) was treated in a continuous processing (a running test) until replenishing had been done in a twice volume as much of a color development tank in the processing processes described below. The processing of using these running solutions was named as Processing A.

| Processing Process | Temperature | Time | Replenishing Amount* |
|---|---|---|---|
| Color Development | 38.5° C. | 45 sec | 45 mL |
| Bleach and Fix | 38.0° C. | 45 sec | 35 mL |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 mL |

*A replenishing amount per 1 $m^2$ of a photosensitive material
**A rinse-cleaning system RC50D manufactured by Fuji Photo Film Co., Ltd. was installed in Rinse (3). A replenishing solution was taken out of Rinse (3) and sent to a reverse osmosis membrane module (RC50D) by means of a pump. Permeated water obtained in the tank was supplied to Rinse (4) and condensed liquid was returned to Rinse (3).

A pump pressure was adjusted to keep a volume of permeated water in the range of from 50 mL/min to 300 mL/min. Circulation under temperature control was conducted for 10 hours a day. [Rinse processes were arranged in a tank countercurrent system from (1) to (4)].

The composition of each processing solution is as described as follows.

| [Color Developer] | [Tank Solution] | [Replenishing Solution] |
|---|---|---|
| Water | 800 mL | 800 mL |
| Dimethyl polysiloxane-based Surfactant (Silicone KF351A manufactured by The Shin-Etsu Chemical Co., Ltd.) | 0.1 g | 0.1 g |
| Tri(isopropanol) amine | 8.8 g | 8.8 g |
| Ethylenediamine tetra-acetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-based fluorescent whitening agent (Hakkol FWA-SF manufactured by Showa Chemical Co., Ltd.) | 2.5 g | 2.5 g |
| Sodium sulfite | 0.1 g | 0.1 g |
| Disodium-N,N-bis(sulfonatethyl) hydroxylamine | 8.5 g | 11.1 g |
| N-ethyl-N-(β-methane sulfonamide ethyl)-3-methyl-4-amino-4-aminoaniline 3/2 sulfuric acid mono hydrate | 5.0 g | 15.7 g |
| Potassium carbonate | 26.3 g | 26.3 g |
| Water to make | 1000 mL | 1000 mL |
| pH (adjusted by potassium hydroxide and sulfuric acid at 25° C.) | 10.15 | 12.50 |

| [Blix Solution] | [Tank Solution] | [Replenishing Solution] |
|---|---|---|
| Water | 700 mL | 600 mL |
| Iron (III) ammonium ethylene diamine tetra-acetate | 47.0 g | 94.0 g |
| Ethylene diamine tetra-acetic acid | 1.4 g | 2.8 g |
| m-carboxybenzene sulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 mL | 214.0 mL |
| Ammonium sulfite | 16.0 g | 32.0 g |
| Ammonium bisulfite | 23.1 g | 46.2 g |
| Water to make | 1000 mL | 1000 mL |
| pH (adjusted by acetic acid and ammonia at 25° C.) | 6.0 | 6.0 |

| [Rinse Solution] | [Tank Solution] | [Replenishing Solution] |
|---|---|---|
| Sodium chloroisocyanurate | 0.02 g | 0.02 g |
| Deionized water (electric conductivity: 5 μs/cm or less) | 1000 mL | 1000 mL |
| pH | 6.5 | 6.5 |

On Sample (101) to (106) which were thus processed as described above, a yellow color density was measured.

A fog value was obtained from the lowest color density of each Sample. A photosensitivity was determined as an inverse number of an exposure amount necessary for obtaining the color density of fog +1.0 and expressed as a relative value to the photosensitivity of Sample (101) (assumed as 100) after development processing.

TABLE 3

| Sample No. | Emulsion No. | Dopant* Class A** | Class B** | Class C** | Class D** | Relative Photosensitivity# 1 sec Exposure | $10^{-4}$ sec Exposure | Gradation## |
|---|---|---|---|---|---|---|---|---|
| 101 Comp | 1-1 | — | — | — | — | 100 | 100 | 2.58 |
| 102 Comp | 1-2 | O | O | O | — | 95 | 201 | 3.57 |
| 103 Comp | 1-3 | — | O+ | — | O | 141 | 230 | 2.49 |
| 104 Inv | 1-4 | O | O | O | O | 145 | 235 | 3.69 |
| 105 Inv | 1-5 | — | O | O | O | 151 | 251 | 2.65 |
| 106 Inv | 1-6 | O | — | O | O | 147 | 235 | 3.65 |

Comp: Comparative Example
Inv: The Present Invention
*The mark "O" means the case where a dopant in the Class was used in each emulsion.
**$[RuCl_5(NO)]^{2-}$ as a dopant in Class A, $[IrCl_6]^{2-/4-}$ as a dopant in Class B, $[IrCl_5(H_2O)]^{2-}$ as a dopant in Class C and $[Ru(CN)_6]^{2-}$ as a dopant in Class D were respectively used.
O+: In case of this emulsion, $[IrCl_6]^{2-/4-}$ as a dopant in Class B was doped in two positions, the pure silver chloride layer and the silver chlorobromide layer.
#The relative photosensitivity was expressed in assuming the photosensitivity of Sample (101) as 100 in each condition.
The gradation of each Sample was expressed as a slope between fog + 0.1 and fog + 0.5.

In Table 3, it is recognized that the doped emulsions of the present invention have a higher photosensitivity than that of well-known doped emulsions, that they show an excellent property against reciprocity law failure and that they are achieved as a contrast-increasing emulsion.

Example 2

Emulsion 2-1

Preparation of Silver Chloride Cube Sample (2) (Comparative Example)

In the preparation method of Emulsion 1-1 described in Example 1, a silver chloride cube emulsion having an average grain size of 0.38 $\mu$m (variation coefficient: 8%) was obtained by performing grain formation in the same manner as that in the preparation method of Emulsion 1-1, except that N,N'-dimethylimidazolidine-2-thione (a 1% aqueous solution) was not added and the temperature of the reaction solution was maintained at 55° C. Further, to this emulsion, a gold sensitizer [gold (I) tetrafluoroborate bis(1,4,5-trimethyl-1,2,4-triazolium-3-thiolate)] in an amount of $2.4\times10^{-5}$ mol/mol Ag, a sulfur sensitizer (sodium thiosulfate) in an amount of $1\times10^{-7}$ mol/mol Ag, and green sensitive spectral sensitizing dyes (D, E and F) in an amount of $3.6\times10^{-4}$ mol/mol Ag, $7.0\times10^{-5}$ mol/mol Ag and $2.8\times10^{-4}$ mol/mol Ag were added. The emulsion was optimally treated at 60° C. in chemical senstization and in spectral sensitization. Furthermore, 1-(5-methylureidophenyl)-5-mercaptoterazole was added in an amount of $4.4\times10^{-4}$ mol/mol Ag, there by Emulsion 2-1 was obtained.

Emulsion 2-2

Preparation of Silver Chloride Cube Sample Doped with Complexes in Class B and Class D (Comparative Example)

Emulsion 2-2 was prepared in the same manner as that in Emulsion 2-1, except that hexachloro iridium as a transition metal complex in Class B in an amount of $2\times10^{-6}$ mol for the silver amount added to the emulsion in the layer ranged from 87% to 97% of the grain volume counted from the center part, and hexacyano ruthenium as a transition metal complex in Class D in an amount of $2\times10^{-5}$ mol for the silver amount added to the emulsion in the layer ranged from 75% to 85% of the grain volume counted from the center part were respectively added to the emulsion of Emulsion 2-1, and further except that silver bromide fine particles doped with hexachloro iridium classified in Class B were added (hexachloro iridium was in an amount of $1.5\times10^{-6}$ mol for the entire silver amount of the emulsion) before chemical sensitization of Emulsion 2-1.

Emulsion 2-3

Preparation of Silver Chloride Cube Sample Doped with Complexes in Class A, Class B and Class C (Comparative Example)

Emulsion 2-3 was prepared in the same manner as that in Emulsion 2-1, except that pentachloronitrosyl ruthenium as a transition metal complex in Class A in an amount of $1\times10^{-8}$ mol for the silver amount added to the emulsion in the layer ranged from 10% to 70% of the grain volume counted from the center part, hexachloro iridium as a transition metal complex in Class B in an amount of $4\times10^{-8}$ mol for the silver amount added in the emulsion in the layer ranged from 96% to 98% of the grain volume counted from the center part, and pentachloro(thiazole)iridium as a transition metal complex in Class C in an amount of $2\times10^{-6}$ mol for the silver amount added in the emulsion in the layer ranged from 87% to 92% of the grain volume counted from the center part were respectively added to the emulsion of Emulsion 2-1.

Emulsion 2-4

Preparation of Silver Chloride Cube Sample Doped with Complexes in Class A, Class B, Class C and Class D (Present Invention)

Emulsion 2-4 was prepared in the same manner as that in Emulsion 2-1, except that pentachloronitrosyl ruthenium as a transition metal complex in Class A in an amount of $1\times10^{-8}$ mol for the silver amount added in the emulsion in the layer ranged from 10% to 70% of the grain volume counted from the center part, hexachloro iridium as a transition metal complex in Class B in an amount of $4\times10^{-8}$ mol for the silver amount added in the emulsion in the layer ranged from 96% to 98% of the grain volume counted from the center part, pentachloroaqua iridium as a transition metal complex in Class C in an amount of $2\times10^{-6}$ mol for the silver amount added in the emulsion in the layer ranged from 87% to 92% of the grain volume counted from the center part, and hexacyano ruthenium as a transition metal complex in Class D in an amount of $2\times10^{-5}$ mol for the silver amount added in the emulsion in the layer ranged from 75% to 85% of the grain volume counted from the center part were respectively added to the emulsion of Emulsion 2-1.

Sample (201) to (204) were prepared in the same layer constitution as that in Example 1, except that the emulsion in the first layer was replaced by Emulsion 2-1 to 2-4. These samples were subjected to Experiment 1 in Example 1 and to Experiment 2 described below.

Experiment 2: Latent Image Stability after Exposure

Each sample was given an exposure to light for 1/10 seconds.

The time after exposure till Processing A was varied, and then sensitometric measurement was conducted. A photosensitivity when the processing was performed after 75 seconds and a photosensitivity when the processing was performed after 30 minutes were measured.

Results of these two experiments are shown in Table 4.

TABLE 4

| Sample No. | Emulsion No. | Dopant* Class A** | Class B** | Class C** | Class D** | Relative Photosensitivity# 1 sec Exposure | $10^{-4}$ sec Exposure | $10^{-6}$ sec Exposure | Sensitivity Difference## |
|---|---|---|---|---|---|---|---|---|---|
| 201 Comp | 2-1 | — | — | — | — | 100 | 100 | 100 | 12 |
| 202 Comp | 2-2 | — | O+ | — | O | 146 | 238 | 213 | 41 |
| 203 Comp | 2-3 | O | O | O++ | — | 98 | 198 | 185 | 17 |
| 204 Inv | 2-4 | O | O | O+++ | O | 151 | 240 | 251 | 4 |

*The mark "O" means the case where a dopant in the Class was used in each emulsion.
**$[RuCl_5(NO)]^{2-}$ as a dopant in Class A, $[IrCl_6]^{2-/4-}$ as a dopant in Class B, and $[Ru(CN)_6]^{2-}$ as a dopant in Class D were respectively used.
O+: In case of this emulsion, $[IrCl_6]^{2-/4-}$ as a dopant in Class B was doped in two positions, the pure silver chloride layer and the silver chlorobromide layer.
O++: In Emulsion 2-3, $[IrCl_5(thia)]^{2-}$ (thia = thiazole) as a dopant in Class C was used.
O+++: In Emulsion 2-4, $[IrCl_5(H_2O)]^{2-}$ as a dopant in Class C was used.
#The relative photosensitivity was expressed in assuming the photosensitivity of Sample (201) as 100 in each condition.
Each value is expressed in a relative photosensitivity difference at a time since exposure till development processing for each sample.

It is recognized that the emulsion of the present invention has no reciprocity law failure caused even by an exposure to light for $10^{-6}$ seconds and constantly gives the same photosensitivity (being excellent in latent image stability) even when a time after exposure to light till processing is different.

Example 3

Samples with thinner layers were prepared by modifying the layer constitution of each sample in Example 2, thereby Sample (301) to (304) were obtained. When these samples were subjected to Experiment 1 in Example land Experiment 2 in Example 2, good results were obtained to recognize the effects of the present invention even with the thinner layered sample processed in a super-rapid processing. Further, the layer constitution will be shown with Sample (301) described below. In each of Sample (302) to (304), Emulsion 2-1 in Sample (301) was replaced by Emulsion 2-2 to 2-4 respectively.

Preparation of Sample (301)

| | |
|---|---|
| First Layer (Blue Sensitive Emulsion): | |
| Emulsion 1-1 | 0.24 |
| Gelatin | 1.25 |
| Yellow Coupler (ExY) | 0.57 |
| Color Image Stabilizer (Cpd-1) | 0.07 |
| Color Image Stabilizer (Cpd-2) | 0.04 |
| Color Image Stabilizer (Cpd-3) | 0.07 |
| Color Image Stabilizer (Cpd-8) | 0.02 |
| Solvent (Solv-1) | 0.21 |
| Second Layer (Color Mixing-Preventing Layer): | |
| Gelatin | 0.60 |
| Color Mixing-Preventing Agent (Cpd-4) | 0.09 |
| Color Image Stabilizer (Cpd-5) | 0.007 |
| Color Image Stabilizer (Cpd-7) | 0.007 |
| Ultraviolet Light Absorber (UV-C) | 0.05 |
| Solvent (Solv-5) | 0.11 |
| Third Layer (Green Sensitive Emulsion Layer): | |
| Emulsion 2-1 | 0.14 |
| Gelatin | 0.73 |
| Magenta Coupler (ExM) | 0.15 |

-continued

| | |
|---|---|
| Ultraviolet Light Absorber (UV-A) | 0.05 |
| Color Image Stabilizer (Cpd-2) | 0.02 |
| Color Image Stabilizer (Cpd-7) | 0.008 |
| Color Image Stabilizer (Cpd-8) | 0.07 |
| Color Image Stabilizer (Cpd-9) | 0.03 |
| Color Image Stabilizer (Cpd-10) | 0.009 |
| Color Image Stabilizer (Cpd-11) | 0.0001 |

-continued

| | |
|---|---|
| Solvent (Solv-3) | 0.06 |
| Solvent (Solv-4) | 0.11 |
| Solvent (Solv-5) | 0.06 |
| Fourth Layer (Color Mixing-Preventing Layer): | |
| Gelatin | 0.48 |
| Color Mixing-Preventing Agent (Cpd-4) | 0.07 |
| Color Image Stabilizer (Cpd-5) | 0.006 |
| Color Image Stabilizer (Cpd-7) | 0.006 |
| Ultraviolet Light Absorber (UV-C) | 0.04 |
| Solvent (Solv-5) | 0.09 |
| Fifth Layer (Red Sensitive Emulsion Layer): | |
| Emulsion 2-1 | 0.12 |
| Gelatin | 0.59 |
| Cyan Coupler (ExC-2) | 0.13 |
| Cyan Coupler (ExC-3) | 0.03 |
| Color Image Stabilizer (Cpd-7) | 0.01 |
| Color Image Stabilizer (Cpd-9) | 0.04 |
| Color Image Stabilizer (Cpd-15) | 0.19 |
| Color Image Stabilizer (Cpd-18) | 0.04 |
| Ultraviolet Light Absorber (UV-7) | 0.02 |
| Solvent (Solv-5) | 0.09 |
| Sixth Layer (Ultraviolet Light-Absorbing Layer): | |
| Gelatin | 0.32 |
| Ultraviolet Light Absorber (UV-C) | 0.42 |
| Solvent (Solv-7) | 0.08 |
| Seventh Layer (Protective Layer): | |
| Gelatin | 0.70 |
| Acryl-modified copolymer of polyvinyl alcohol (degree of modification: 17%) | 0.04 |
| Liquid paraffin | 0.01 |
| Surfactant (Cpd-13) | 0.01 |
| Polydimethyl siloxane | 0.01 |
| Silicon dioxide | 0.003 |

Each of prepared samples was exposed to light in the same manner as that in Experiment 1 in Example 1. Regarding color development processing, these samples were processed by a super-rapid processing according to Processing B described below.

Processing B

The photosensitive material described in the above was processed into a roll-form of 127 mm in width. By using an experimental processing apparatus made by modifying a printer-processor for a mini-laboratory, Model PP 350, manufactured by Fuji Photo Film Co., Ltd. so as to make it possible to vary a processing time and a processing temperature, the photosensitive material was imagewise exposed to light through a negative film of a moderate density, and then treated in a continuous processing (a running test) until the volume of the color development replenishing solution used in the processing processes described below had been reduced to 0.5 times of the color development tank volume.

| Processing Process | Temperature | Time | Replenishing Amount* |
|---|---|---|---|
| Color Development | 45.0° C. | 15 sec | 45 mL |
| Bleach and Fix | 40.0° C. | 15 sec | 35 mL |
| Rinse (1) | 40.0° C. | 8 sec | — |
| Rinse (2) | 40.0° C. | 8 sec | — |
| Rinse (3) | **40.0° C. | 8 sec | — |
| Rinse (4) | **38.0° C. | 8 sec | 121 mL |
| Drying | 80° C. | 15 sec | |

*A replenishing amount per 1 $m^2$ of a photosensitive material

**A rinse-cleaning system RC50D manufactured by Fuji Photo Film Co., Ltd. was installed in Rinse (3). A replenishing solution was taken out of Rinse (3) and sent to a reverse osmosis membrane module (RC50D) by means of a pump. Permeated water obtained in the tank was supplied to Rinse (4) and condensed liquid was returned to Rinse (3).

A pump pressure was adjusted to keep a volume of permeated water in the range of from 50 ml/min to 300 ml/min. Circulation under temperature control was conducted for 10 hours a day. [Rinse processes were arranged in a tank countercurrent system from (1) to (4)].

The composition of each processing solution is as described as follows.

| [Color Developer] | [Tank Solution] | [Replenishing Solution] |
|---|---|---|
| Water | 800 mL | 600 mL |
| Fluorescent Whitening Agent (FL-1) | 5.0 g | 8.5 g |
| Tri(isopropanol) amine | 8.8 g | 8.8 g |
| sodium p-toluene sulfonate | 20.0 g | 20.0 g |
| Ethylenediamine tetra-acetic acid | 4.0 g | 4.0 g |
| Sodium Sulfite | 0.10 g | 0.50 g |
| Potassium chloride | 10.0 g | — |
| Sodium 4,5-dihydroxybenzene-1,3-disulfonate | 0.50 g | 0.50 g |
| disodium-N,N-bis (sulfonatethyl) hydroxylamine | 8.5 g | 14.5 g |
| 4-amino-3-methyl-N-ethyl-N-(β-methane sulfonamide ethyl) aniline 3/2 sulfuric acid mono hydrate | 10.0 g | 22.0 g |
| Potassium carbonate | 26.3 g | 26.3 g |
| Water to make | 1000 mL | 1000 mL |
| pH (adjusted by potassium hydroxide and sulfuric acid at 25° C.) | 10.35 | 12.60 |

| | [Tank Solution] | [Replenishing Solution] |
|---|---|---|
| [Blix Solution] | | |
| Water | 800 mL | 800 mL |
| Ammonium thiosulfate (750 g/L) | 107 mL | 214 mL |
| Succinic acid | 29.5 g | 59.0 g |
| Iron (III) ammonium ethylene diamine tetraacetate | 47.0 g | 94.0 g |

-continued

| | [Tank Solution] | [Replenishing Solution] |
|---|---|---|
| Ethylene diamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 mL | 1000 mL |
| pH (adjusted by nitric acid and ammonia at 25° C.) | 6.00 | 6.00 |
| [Rinse Solution] | | |
| Sodium chloroisocyanurate | 0.02 g | 0.02 g |
| Deionized water (electric conductivity: 5 μs/cm or less) | 1000 mL | 1000 mL |
| pH (at 25° C.) | 6.5 | 6.5 |

FL-1

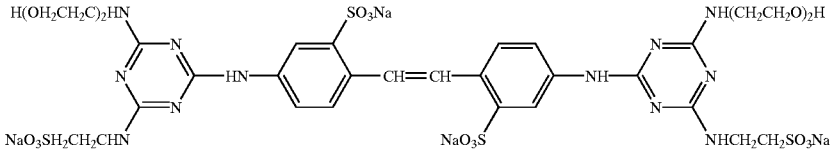

Example 4

Image formation was performed with Sample (301) to (304) by means of laser-scanning exposure. As laser light sources, the followings were used: 473 nm obtained by wavelength conversion (through an SHG crystal of $LiNbO_3$ having a reversal domain structure) of light from a YAG solid laser (generating wavelength: 946 nm) utilizing a semiconductor laser GaAlAs (generating wavelength: 808.5 nm) as an exciting light source; 532 nm obtained by wavelength conversion (through an SHG crystal of $LiNbO_3$ having a reversal domain structure) of light from a $YVO_4$ solid laser (generating wavelength: 1064 nm) utilizing a semiconductor laser GaAlAs (generating wavelength: 808.7 nm) as an exciting light source; and an AlGaInP laser (generating wavelength: approximately 680 nm, Type No. LN9R20 manufactured by Matsushita Electric Industrial Co., Ltd.). Each laser light of three colors was moved by means of a polygon mirror in the vertical direction in relation to the scanning direction so as to make a sequential scanning exposure on a sample. The light amount variation of a semiconductor laser dependent on a temperature was restrained by maintaining the temperature constant by utilizing a Peltier device. The effective beam diameter was 80 μm, the scanning pitch was 42.3 μm (600 dpi), and the average exposure time per pixel was $1.7\times10^{-7}$ seconds.

After being exposed to light, Sample (304) of the present invention was processed by the color development processing (Processing B). In the same manner as the results with high intensity exposures in Example 2, Sample (304) of the present invention showed a high photosensitivity. It was recognized that Sample (304) of the present invention suited for image formation using a laser scanning exposure.

EFFECT OF THE INVENTION

The present invention utilizes the concept of an electron-releasing time on the function of a dopant and has the basis of knowledge that an emulsion without reciprocity law failure over the whole exposure light intensities can be obtained by using dopants in proper combination each having an electron-releasing time properly adapted to an exposure intensity necessary for the emulsion. By expanding this knowledge to the properties needed by the emulsion (a way of thinking on photosensitivity and gradation), it became possible to obtain an emulsion without reciprocity law failure and with a high photosensitivity as well as a high contrast in a broad range of exposure light intensity.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising silver halide grains containing three or more kinds of transition metal complexes each having a different electron-releasing time respectively classified into any of Class A (100 seconds or more), Class B (more than 1/10 seconds and less than 100 seconds), Class C (more than 1/1000 seconds and 1/10 seconds or less) and Class D (1/1000 seconds or less), wherein at least one of the three or more kinds of transition metal complexes contained in the silver halide grains is a transition metal complex classified in Class C, and further at least one of the three or more kinds of transition metal complexes contained in the silver halide grains is a transition metal complex classified in Class D.

2. The silver halide emulsion as claimed in claim 1, wherein the silver halide grains contain three kinds of transition metal complexes each having a different electron-releasing time respectively classified into Class B, Class C or Class D.

3. The silver halide emulsion as claimed in claim 1, wherein the silver halide grains contain three kinds of transition metal complexes each having a different electron-releasing time respectively classified into Class A, Class C or Class D.

4. The silver halide emulsion as claimed in claim 1, wherein each of the three or more kinds of transition metal complexes contained in the silver halide grains respectively includes at least one central metal selected from the group consisting of ruthenium, osmium, rhodium, iridium, iron, cobalt, nickel, zinc, lead and cadmium.

5. The silver halide emulsion as claimed in claim 1, wherein at least one of the three or more kinds of transition metal complexes contained in the silver halide grains is an iridium complex or a ruthenium complex having at least one halogen ion as its ligand.

6. The silver halide emulsion as claimed in claim 1, wherein complex in Class C contained in the silver halide grains is iridium complex represented by General Formula (I):

$$[IrX_nL_{6-n}]^m \quad (I)$$

wherein X represents a halogen ion, L represents an inorganic compound except halogen or an organic compound, n represents 4 or 5, and m represents an integer of from −4 to +2.

7. The silver halide emulsion as claimed in claim 1, wherein at least one of the three or more kinds of transition metal complexes contained in the silver halide grains is classified in Class B, and the complex in Class B is an iridium complex or a ruthenium complex having at least one halogen ion as its ligand.

8. The silver halide emulsion as claimed in claim 1, wherein the silver halide emulsion has a silver chloride content ratio of 95% or more.

9. The silver halide emulsion as claimed in claim 1, wherein the silver halide emulsion is subjected to gold sensitization.

10. A silver halide emulsion comprising silver halide grains containing four or more kinds of transition metal complexes, wherein at least three kinds of transition metal complexes among the four or more kinds of transition metal complexes each have a different electron-releasing time respectively classified into any of Class A (100 seconds or more), Class B (more than 1/10 seconds and less than 100 seconds), Class C (more than 1/1000 seconds and 1/10 seconds or less) and Class D (1/1000 seconds or less).

11. The silver halide emulsion as claimed in claim 10, wherein at least one transition metal complex is classified in Class C.

12. The silver halide emulsion as claimed in claim 10, wherein the complex in Class C contained in the silver halide grains is an iridium complex represented by General Formula (I):

$$[IrX_nL_{6-n}]^m \quad (I)$$

wherein X represents a halogen ion, L represents an inorganic compound except halogen or an organic compound, n represents 4 or 5, and m represents an integer of from −4 to +2.

* * * * *